US007086854B2

(12) United States Patent
Rakhmailov et al.

(10) Patent No.: US 7,086,854 B2
(45) Date of Patent: Aug. 8, 2006

(54) COMBUSTION METHOD AND APPARATUS FOR CARRYING OUT SAME

(75) Inventors: Anatoly M. Rakhmailov, San Diego, CA (US); Anatoly A. Rakhmailov, San Diego, CA (US)

(73) Assignee: ALM Blueflame, LLC, Washington, DC (US)

( * ) Notice: Subject to any disclaimer, the term of this patent is extended or adjusted under 35 U.S.C. 154(b) by 0 days.

(21) Appl. No.: 10/927,693

(22) Filed: Aug. 27, 2004

(65) Prior Publication Data

US 2005/0084812 A1 Apr. 21, 2005

Related U.S. Application Data

(60) Provisional application No. 60/585,958, filed on Jul. 6, 2004, provisional application No. 60/508,405, filed on Oct. 3, 2003.

(51) Int. Cl.
*F23C 9/00* (2006.01)
*F23M 9/00* (2006.01)
*F02C 3/00* (2006.01)

(52) U.S. Cl. ..... 431/116; 431/9; 60/750

(58) Field of Classification Search ..... 431/116, 431/115, 8, 9; 60/749, 750, 755, 737
See application file for complete search history.

(56) References Cited

U.S. PATENT DOCUMENTS

| | | | | |
|---|---|---|---|---|
| 1,952,281 A | | 3/1934 | Ranque | |
| 2,532,740 A | * | 12/1950 | Speer | 431/116 |
| 2,959,215 A | * | 11/1960 | Warnecke | 431/116 |
| 3,309,866 A | | 3/1967 | Kydd | |
| 3,826,083 A | * | 7/1974 | Brandon et al. | 60/750 |
| 3,994,665 A | * | 11/1976 | Young | 431/116 |
| 4,455,839 A | * | 6/1984 | Wuchter | 60/737 |
| 4,586,328 A | | 5/1986 | Howald | |
| 5,266,024 A | | 11/1993 | Anderson | |
| 5,857,339 A | | 1/1999 | Roquemore et al. | |
| 6,295,801 B1 | | 10/2001 | Burrus et al. | |

* cited by examiner

FOREIGN PATENT DOCUMENTS

GB 1 381 347 A * 1/1975

OTHER PUBLICATIONS

W. M. Roquemore et al., "Role of Flow Visualization in the Development of Unicorn," International Conference on Optical Technology and Image Processing in Fluid, Thermal, and Combustion Flow, Dec. 6-9, 1998, Yokohama, Japan.

*Primary Examiner*—Josiah C. Cocks
(74) *Attorney, Agent, or Firm*—Hughes Hubbard & Reed LLP; Ronald Abramson; Jason Liu

(57) ABSTRACT

The invention relates to recirculation flow combustors having a generally curved recirculation chamber and unobstructed flow along the periphery of the boundary layer of the vortex flow in this chamber, and methods of operating such combustors. Such combustors further have a border interface area of low turbulence between the vortex flow and the main flow in the combustor, in which chemical reactions take place which are highly advantageous to the combustion process, and which promote a thermal nozzle effect within the combustor. A combustor of this type may be used for burning lean and super-lean fuel and air mixtures for use in gas turbine engines, jet and rocket engines and thermal plants such as boilers, heat exchanges plants, chemical reactors, and the like. The apparatus and methods of the invention may also be operated under conditions that favor fuel reformation rather than combustion, where such a reaction is desired.

37 Claims, 12 Drawing Sheets

Combustion Temp. = 600°C

COMBUSTION METHOD AND APPARATUS FOR CARRYING OUT SAME

CROSS-REFERENCE TO RELATED APPLICATIONS

This application claims the benefit of U.S. Provisional Application No. 60/508,405, filed on Oct. 3, 2003, and U.S. Provisional Application No. 60/585,958, filed Jul. 6, 2004.

BACKGROUND OF THE INVENTION

1. Field of the Invention

The invention relates to a combustion apparatus and method for burning fuel in a mixture with air with the aim of producing hot gas for various applications. More specifically, the invention relates to a combustion apparatus and method using a combustor with recirculation flow. The invention further relates to an apparatus and method for igniting and burning a mixture of fuel and air. A combustor of this type may be used for burning lean and super-lean fuel and air mixtures for use in gas turbine engines, jet and rocket engines and thermal plants such as boilers, heat exchanges plants, chemical reactors, and the like. The apparatus and methods of the invention may also be operated under conditions that favor fuel reformation rather than combustion, where such a reaction is desired.

2. Description of Related Art (The following description or related art should be read in light of the definitions of certain terms provided in the detailed description below.)

In a typical combustor, combustion air and fuel (which may or may not be premixed) is introduced through an inlet opening to a combustion space, where the combustion process occurs. Recirculation flow may be present, in which the burning gases are recirculated within the combustor before rejoining the main combustion flow. Introducing a high-speed, high-temperature, large mass recirculation flow injects thermal and kinetic energy into the main combustion flow, thus allowing stable combustion of lean and very lean fuel/air mixtures, and lowering harmful emissions, among other advantages.

Although a recirculation flow is present in many combustion methods and apparatuses, recirculation flow in existing combustors occurs within the combustion space without being confined to a special space for an organized movement. As a result, existing combustors do not maximize the velocity of the recirculation flow, and thus do not maximize the amount of thermal and kinetic energy injected into the main combustion flow, which would be desirable for efficient and reliable combustion of lean and very lean fuel/air mixtures.

For example, U.S. Pat. No. 4,586,328 to Howald discloses a generally toroidal-shaped combustor in which the combustion mixture burns along a generally toroidal-helical gas flow path. However, the recirculation flow (burning gas) that is fed back to the inlet opening zone within the combustion chamber does not have a velocity that is high enough; hence very low energy is supplied to the fresh fuel/air mixture. The outlet of the periphery of the torroidal flow path is into the turbine. Further, in Howald, additional cooling flows are introduced between the air flow and the flow of recirculated burning gas. Consequently, the conditions for injecting the burning gases into the air flow or into the fuel/air mixture flow are impaired, and the amount of energy supplied by the recirculation flow to the fuel/air mixture is low. The solution is to make the fuel/air mixture richer, which is not desirable because it results in a higher combustion temperature, incomplete combustion, and increased harmful emissions.

U.S. Pat. No. 3,309,866 to Kydd discloses a process and apparatus for flameless gas combustion in which recirculation occurs (i.e. hot, substantially completely burned gas within the combustor is combined with the fuel/air mixture entering the combustor). Like Howald, the combustor disclosed by Kydd does not maximize the velocity of the recirculation flow, thus resulting in a low level of energy being supplied to the main combustion flow. As in Howald, the flow along the periphery of the torroidal circulation area also feeds into the turbine. In addition, the combustor in Kydd includes a baffle in the form of an annular plate with holes, so the burning gases do not directly flow into the fresh fuel/air mixture, thereby impairing the conditions for injecting the burning gases into the fuel mixture. The main disadvantage here is thorough mixing, with the fuel and air mix admitted and thoroughly mixed with almost completely burned gases that are in a swirl motion.

In U.S. Pat. No. 5,857,339 to Roquemore et al., a trapped vortex combustor with hot gas recirculation to the main flow inlet has fuel and air inlets for admitting fuel and/or air to the recirculated hot gases before the hot gases meet the main flow. Similarly to other known combustors, the temperature of the recirculated hot gases meeting the fresh fuel and air mixture decreases rapidly because, among other things, of intensive fuel reforming processes which are occurring in the fresh fuel and air mixture. In this case, adding air and/or fuel to the recirculated hot gases is counterproductive because the temperature of the recirculated hot gases will be already lowered before they meet the main flow. The geometry of the combustion space is such that the recirculated hot gases meet the main flow as close as possible to a co-current flow. This means that the primary objective is to achieve the lowest hydraulic losses possible when the recirculated flow meets the incoming main flow. This geometry of mixing of the two flows is very disadvantageous, because the "mild" conditions at collision of the two flows result in a very poor energy transfer between the flows, and non-uniformity or temperatures at the main flow inlet can reach up to 100%, and the inner layers of the incoming main flow may not be heated at all. This results in poor heating of the incoming main flow with the resulting flameout. A typical temperature profile for combustors of this type (see FIG. 19) shows that the temperature of the incoming main flow in a trapped vortex combustor at the inlet to the combustion space remains practically the same as the temperature of the main flow fed to the combustor. The consequence of this is high non-uniformity of combustion temperature axially along, and radially of the combustor, which translates into lower flame stability when the fuel and air mixture becomes leaner and also to high CO and $NO_x$ emissions. It should be added that the use of additional air and/or fuel inlets in the path of the recirculation flow is very disadvantageous because they create non-uniformity of the velocity profile within the recirculation flow, which translates into increased non-uniformity of energy transfer between the recirculated hot gases and the incoming main flow.

In U.S. Pat. No. 6,295,801 to Burrus et al., a combustor uses the trapped vortex operation principle to sustain a pilot flame. This design has the same disadvantages as those described above. The main advantage of this trapped vortex design here is stability of the pilot flame. This is done because the main flame stability could not be achieved in the prior art without using additional devices. The vortex velocity cannot be equal to the inlet flow velocity. Air is fed to the vortex zone through ports having a velocity coefficient of about 0.75. The main air flow is admitted to the combustor through profiled passages having a velocity coefficient of about 0.9. With an ideal isentropic velocity of 100 m/s, the main air flow velocity will be 90 m/s, and the vortex velocity will be 75 m/s. The velocity the flow fed to the vortex could be increased with the available pressure differential before feeding air to the vortex, or the pressure differential can be increased. It should be noted, however, that the temperature of the fluid admitted to the vortex should not be below the gas temperature in the vortex, i.e., the combustion products should be added to the vortex. The main flow undergoes sudden expansion, which results in a velocity decrease. In general, the turbulent character of vortex flow results in a velocity decrease. All these factors do not allow additional energy to be supplied to the incoming main flow.

It can be summarized that the use of trapped vortex in combustors in the prior art is mainly characterized by heating the surface layers of the incoming main flow, which in itself is not bad and can bring about certain improvements in sustaining lean mixture flame. On the other hand, the superficial heating cannot result in any dramatic improvement of flame stability and emission reduction.

In these prior art recirculation flow combustors, the recirculation flow of hot gases is diluted (cooled) with a flow of secondary air and then the cooled recirculated gases are directed to the primary air the inlet, which should be heated. (See FIG. 20.) Fuel is added to the hot recirculated gases diluted with the secondary air flow before it meets the primary (main) air flow. Admitting fuel to the hot recirculated gas results in a very non-uniform conditions for combustion because a very small quantity of fuel cannot be mixed thoroughly with a very large quantity of the recirculated gases and secondary air. Fuel reforming will be very intense and non-uniform in this case with the ensuing cooling. The fuel is then ignited, and the temperature of the gases increases, but this increase will be partly used to compensate for the temperature reduction because of the fuel reforming. The flow then meets the primary (main) air flow (which is actually a secondary flow because the mixture is already burning) and is again cooled. The main flow cannot be heated at the inlet because the recirculated hot gases have been already cooled down twice (first, with the secondary air flow and second, by admitting fuel), and the recirculation flow heating by fuel burning has been partly spent to compensate for reforming temperature losses. It is not possible to heat the main flow at the inlet uniformly over the entire cross-section because the result depends entirely on the turbulent mixing of the two flows, which cannot assure uniform mixing through the entire volume. This reliance on the turbulent (mechanical mixing) is all the more questionable because the two flows move practically co-currently.

The temperature in the recirculation flow in all the above-described combustors cannot be higher than the TIT (turbine inlet temperature). (See FIG. 21.) The preferred temperature in the recirculation flow based on $NO_x$ and CO emissions tradeoff is 1100–1200° C. Adding air and/or fuel to the recirculated hot gases results in a reduction in the recirculation gas temperature. There are two major consequence of this. First, CO emissions will increase. Second, more combustion products will have to be added to the incoming flow in order to increase the incoming flow temperature, which causes an increase in fuel reforming, thus bringing temperature down. Therefore, the use of trapped vortex and recirculated flow in the prior art combustors, while bringing about certain improvement in flame stability and emission performance, has not been able to result in any breakthrough.

U.S. Pat. No. 5,266,024 to Anderson discloses the use of a thermal nozzle to increase the kinetic energy of a flow of oxidant to a blow torch by supplying heat to the flow.

U.S. Pat. No. 1,952,281 to Ranque discloses the phenomenon, and apparatus for creating the phenomenon, whereby in a vortex tube having one tangential inlet flow of compressed fluid, heat is transferred between rotating layers of fluid in the vortex tube, resulting in a separation of the rotating fluid into a hot outer flow and a cold inner flow, which may be taken from separate outputs.

SUMMARY OF THE INVENTION

The present invention relates to recirculation flow combustors having a generally curved recirculation chamber and unobstructed flow along the periphery of the boundary layer of the vortex flow in this chamber. Such combustors further have a border interface area of low turbulence between the vortex flow and the main flow in the combustor, in which chemical reactions take place which are highly advantageous to the combustion process, and which promote a thermal nozzle effect within the combustor. A combustor of this type may be used for burning lean and super-lean fuel and air mixtures for use in gas turbine engines, jet and rocket engines and thermal plants such as boilers, heat exchanges plants, chemical reactors, and the like. The apparatus and methods of the invention may also be operated under conditions that favor fuel reformation rather than combustion, where such a reaction is desired.

More particularly, the invention provides a combustor comprising a reactor; an inlet for admitting a main flow of fluid to said reactor; an exit for discharging heated fluid from said reactor; said reactor positioned between said inlet and said exit and comprising a main flow zone, through which a majority of said main flow passes along a main flow path, and a recirculation zone, through which a lesser portion of said main flow passes; wherein said recirculation zone is defined in part by a wall having an interior surface curved in one direction in a substantially continuous manner and running from a take off point proximate to said exit to a return point proximate to said inlet, said interior surface being shaped and positioned with respect to said main flow path in such a manner as to divert part of the fluid in said main flow path at said take off point to form a recirculation vortex flow in said recirculation zone during the operation of said reactor; and wherein said interior surface is further characterized by a lack of discontinuities so as to cause substantially undisturbed movement of a boundary layer along the periphery of said recirculation vortex flow. Furthermore, a thermal nozzle effect results from chemical reactions that take place within the border or "interface" layer between said recirculation vortex flow and the main, linear, flow of fluid in the reactor.

The invention further provides methods for reacting fuel in a combustor such as described above, comprising the steps of: passing a majority of said main flow in a path along said main flow zone; passing a lesser portion of said main flow in a path through said recirculation zone, so as to form a recirculating vortex flow that returns a portion of the fluid in said recirculation zone to an area proximate said inlet; causing a boundary layer of recirculating fluid to flow around said interior wall surface of said recirculation zone without substantial turbulence; causing the peripheral portion of said recirculating vortex flow to intersect said main flow in an area proximate said inlet, wherein said peripheral flow has a higher velocity than said main flow; said peripheral flow, following the point of said intersection, is moving in approximately the same direction as said main flow; mixing said peripheral flow and said main flow by thermal diffusion and not by substantial mechanical mixing; thereby forming an interface layer between said main flow and said peripheral flow and causing a substantial transfer of heat energy from the fluid in said peripheral flow through said interface layer and into the fluid in said main flow zone.

The implementation of the invention will be more apparent from a review of the accompanying drawings and of the description that follows.

DETAILED DESCRIPTION

The invention will now be described in further detail and with reference to the accompanying drawings, illustrating non-limiting exemplary embodiments of the combustor according to invention.

As a preliminary matter, we provide some definitions for purposes of understanding this specification and the claims.

| | |
|---|---|
| Flame | a thin area where chain oxidation reaction is |
| Combustion | starting a chain reaction of fuel oxidation. |
| Inflammation (or firing, as in the usage "to be fired") | the beginning stage of a chain oxidation reaction. |
| Flameless combustion | the phenomenon of the occurrence of oxidation reactions uniformly throughout the volume of the main flow |
| Reactor | device for the chemical reaction realization |

This specification generally uses the term "combustor" to refer to the apparatus described herein, although, as will be described, apparatus in accordance with the invention may be operated under conditions that favor fuel reformation rather than combustion. The term "reactor" is sometimes used herein as a more general alternative to "combustion chamber" or "combustion space" because under some conditions, by intention, fuel reformation may be the predominant process taking place therein.

In addition, it should be kept in mind that combustion and/or reformation are complex chemical processes with complicated kinetics, and that more than a thousand different chemical reactions will occur at various times in any given reactor. Generally, the reactions within the reactor include, in addition to direct oxidation of fuel to carbon dioxide and water, numerous intermediate and alternate reactions, including:

a) Thermal decomposition of fuel, for example, $CH_4 \rightarrow C+2H_2$ b) Partial oxidation of fuel, for example, $2CH_4+O_2 \rightarrow 2CO+4H_2$ (Methane is given as the most elementary example, with corresponding different reactions taking place with other fuels.) These reactions occur in particular where the temperatures are lower than temperatures in prior art combustors, and without using a catalyst. In addition, we also observe (for example):

c) Fuel reforming, $C+CO_2 \rightarrow CO+CO$ (Oxidation-Reduction)

d) Fuel combustion, $C+O_2 \rightarrow CO_2$ (Oxidation)

e) Fuel reforming H2+CO2→H2O+CO (Oxidation-Reduction)

f) Fuel combustion, $2CO+O_2 \rightarrow 2CO_2$ (Oxidation)

f) Fuel combustion, $H_2+O_2 \rightarrow H_2O$ (Oxidation)

g) Fuel reforming, $C+H_2O \rightarrow H_2+CO$ (Oxidation-Reduction)

Note also that fuel reforming and combustion are both sometimes characterized herein as one type of chemical reaction, which are oxidation-reduction and an oxidation reaction. That is because in each case all "hot" reaction products ($H_2O$ and CO) are being formed by an oxidation process. Of course it is understood that during fuel reforming there are also "cold" reaction products (CO) which are formed by a reduction reaction.

Figure 6:
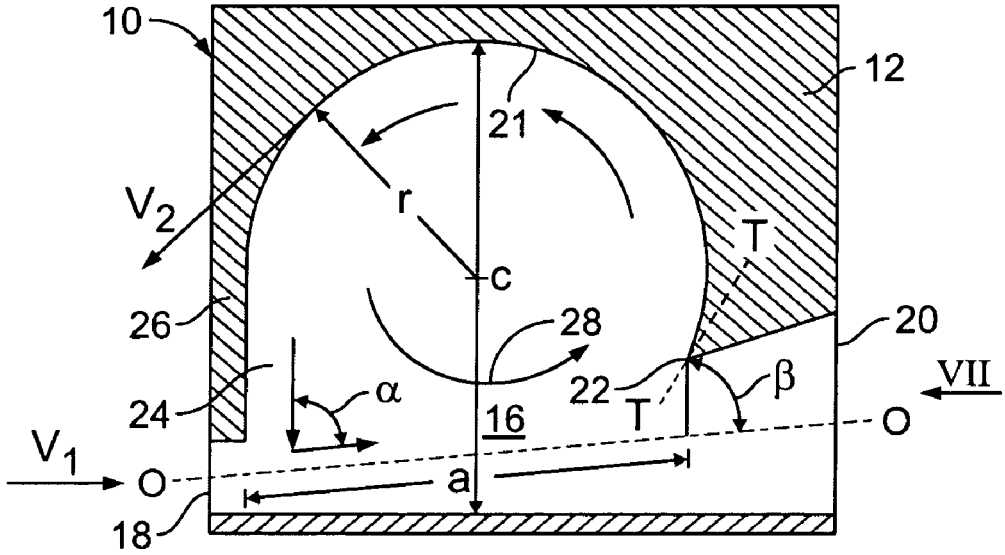
FIG. 6 is a sectional view of a combustor according to the invention as applied to a burner.
Figure 7:
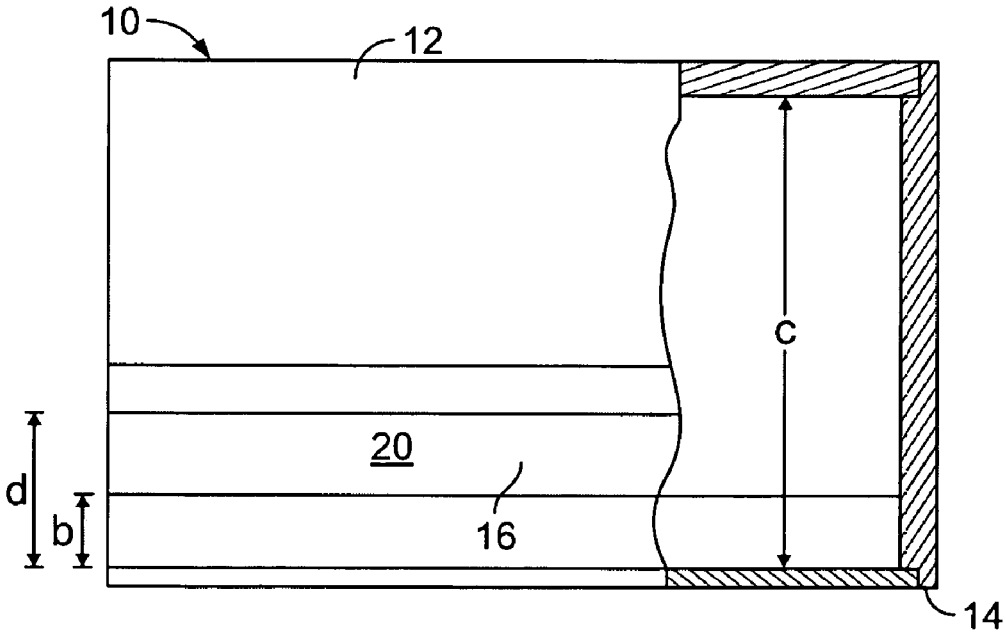
FIG. 7 is a view partially in section taken along arrow VII in FIG. 6.

Turning now to the drawings, FIGS. 6 and 7 are two views of one embodiment of the invention. This embodiment provides a combustor 10 having a combustion space or reactor 16 between an inlet 18 for admitting a main flow of fluid to the combustion space, and an exit 20 for discharging heated fluid from the combustion space, said combustion space comprising a main flow zone, through which a majority of the main flow passes along a main flow path, and a recirculation zone, through which a lesser portion of the main flow passes along a path. The circulation zone is defined in part by a wall having an interior surface 21 curved in one direction in a substantially continuous manner, arranged with respect to the main flow of fluid and the main flow path and shaped in such a manner as to cause a recirculation vortex flow of a part of the fluid in the main flow path at a take off point that are returned from the take off point near the exit to a return point near the inlet before the fluid is discharged from the combustion space, and further arranged, without any discontinuities, so as to cause substantially undisturbed movement of the boundary layer along the periphery of said recirculation vortex flow.

Preferably, the volume of the recirculation zone is no less than the volume of the main flow zone when the reactor 16 functions as a combustion chamber. However, when the reactor 16 functions as a reformer, which will be discussed below, the volume of the recirculation zone is preferably no less than the double volume of the main flow zone.

As will be further described, a thermal nozzle effect results from chemical reactions that take place within the border or "interface" layer between said recirculation vortex flow and the main, linear, flow of fluid in the reactor 16.

The combustor according to the invention provides for a recirculation vortex flow. At the interface between the flow in this vortex, and the main flow in the main flow zone, is a "border" or "interface" layer. There is also a peripheral or boundary layer between the wall of the recirculation zone and the vortex flow, which boundary layer has a substantially laminar flow. More particularly, the boundary layer has a degree of turbulence of less than 0.2 (preferably between 0.008–0.01).

The undisturbed recirculation flow in the peripheral and border layers provides the following advantages:

The vortex layers are not substantially mixed radially within the vortex, which allows for retaining the distribution profile of hot gas molecules in the vortex, with the "hot" molecules of primary CO, $CO_2$ and $H_2O$ moving to the periphery of the recirculation flow vortex, and CO is burned there, and the "cold" molecules of fuel reforming and dissociation products, secondary CO, $H_2$, and oxygen moving from the periphery to the center of the vortex where they participate in oxidation reactions inside the vortex. This separation occurs as a result of the inertial diffusion in the centrifugal field of forces. As a result, the interface or intersection between the recirculation vortex flow and the incoming main flow of fluid will be at the highest temperature possible, and the vortex will always have a combustible material supply without any mixing of the layers.

The velocity of the vortex interior to its peripheral layer is higher than the velocity of the incoming main flow of fluid because of the thermal nozzle effect and also because of a very low degree of turbulence of the recirculation flow (which is achieved by providing the circular surface arranged to assure natural flow and made to assure the undisturbed flow along this surface).

The presence of the border and peripheral layers allow combustion of the fuel to be completed within approximately 2 ms or less.

A reformation reaction takes place along the vortex peripheral layer, involving $CO_2$ and C reacting to form 2CO. Although initially formed as one "hot" and one "cold" CO molecule, by the time this layer rejoins the main flow at the inlet area it has warmed substantially, due, among other factors, to contact with the hot chamber wall. This peripheral vortex flow of hot CO, which serves as a fuel, is extremely advantageous when properly mixed with the incoming fuel and air mixture at the inlet, as will be further described.

The ratio of recirculation flow to main (linear) flow in the combustor may vary. The ratio of fluid entering the vortex compared to fluid exiting the combustor at the exit is preferably no less than seven percent (7%) in the operating mode in which the reactor functions as a combustion chamber and no less than ten percent (10%) in the operating mode in which the reactor functions as a reformer.

As discussed above, a flow of fluid or boundary layer forms along the periphery of the recirculation zone. To keep this flow of a desirable depth, the surface of this chamber should be curved, keeping it curved in one direction (e.g., not back and forth) in a substantially continuous manner. This depth of the boundary layer will be about 1 mm when the fluid at the exit has a temperature of approximately 1100 degree C., and about 2 mm when the fluid at the exit has a temperature of approximately of 800 degree C., and much deeper at lower temperatures, e.g., 380–420 degrees C., to the point where the boundary layer will have a depth larger than the diameter of the central core of the recirculating fluid in the recirculation vortex flow.

As a result, the following conditions are obtained in an intersection point or area near the inlet where the periphery of the vortex meets the incoming main flow of fluid that is admitted to the combustion space: the highest temperature is at the interface of the two flows and there is a high relative velocity between the two flows moving the in the same direction following the intersection point. The result of these two conditions is the highly intensive heat transfer from the vortex periphery to the interfacing surface of the incoming main flow, characterized by a very high heat transfer rate because of the above mentioned conditions. Therefore, the vortex can transfer heat energy to the interfacing layer of the incoming main flow in the most efficient way. For this reason, the surface layer of the incoming main flow is fired and burns steadily irrespective of the fuel/air ratio, acting as a pilot flame without, however an appreciable turbulent mixing between the two flows which would result in formation of "hot" and "cold" spots, averaging of temperatures, and other undesired phenomena inherent in the best embodiments of prior trapped vortex combustors. It should be noted that as the result of the inertial diffusion, the burned fuel gets to the surface layer of the incoming flow first, and the "cold" molecules leave for the central part of the vortex, thus providing conditions for a chain reaction, i.e., oxidation at the rates commensurable with the combustion rates, and the combustion rate can also increase with a further increase in the ratio of the vortex velocity to the incoming flow velocity, thus leading to a controlled explosive combustion with a much leaner mixture than used in the conventional combustors ($k_e$ of about 0.5). This phenomenon results in a sudden increase in the temperature of the incoming flow, and, as a consequence of this, to rapid and uniform heating through the entire body of the incoming flow at the very entry to the combustion space, with the result that the kinetic energy or velocity of the incoming flow starts increasing from the inlet area and this increase continues up to the exit area, thus providing the thermal nozzle effect, which gives an impulse to the recirculation vortex flow to move at a higher velocity. It should be also noted that the rapid heating through the incoming flow occurs without mechanical (turbulent) mixing of the vortex recirculation flow and the incoming flow of fluid, using only the mechanism described above.

The use of the thermal nozzle phenomenon in the combustor according to the invention allows for increasing the velocity of the fluid flow through the exit from the combustion space while almost completely eliminating the turbulent mixing of the recirculation (vortex) flow with the main body of the fluid flow through the combustion space. Losses in the combustion space are thereby substantially reduced. The use of a circular surface for creating the thermal nozzle effect, with the circular surface not having any flow disturbing elements such as openings, recesses, protrusions, fluid inlets, and the like, assures redistribution of the gas molecules in the recirculation vortex flow, among other things, by virtue of the above-mentioned inertial diffusion and the rapid heating through the body of the incoming fluid flow combined with a steady high-temperature interface between the two flows. The absence of mixing, which would entail formation of "hot" and "cold" spots, assures minimum levels of $NO_x$ formation. Since the combustion products are not mixed with the incoming fluid by turbulence (mechanical mixing), the incoming fuel and air mixture, which can be very lean, does not become leaner because the combustion gases and the fuel/air mixture move co-currently (in the same direction at different velocities), without their mechanical mixing. This advantage allows for maintaining combustion of very lean mixtures at any temperature at which oxidation of a hydrocarbon fuel is theoretically possible.

The combustion temperature of a hydrocarbon fuel may be below 500° C., with the combustor exit gas temperature as low as 350–330° C. This is the oxidation temperature, so the $CO_2$ and $H_2O$ formation rate should have decreased by more than 1000 times if a conventional combustor design is used. However, because of the above-described inertial diffusion, the rate of relocation of the newly formed CO, $CO_2$, and $H_2O$ into the area with higher fuel content (from the center to the periphery of the vortex) and then to the interface layer is several times higher than the normal combustion rate, which is about 1 m/s, and the rate of fuel component oxidation in the combustor according to the invention is of the same order as the combustion rate in prior art combustors.

As mentioned above, no fluid (including fuel) is added to the combustion products in the recirculation flow (at least not within the major portion of the circular recirculation flow surface between the inlet and exit of the combustion space), and the degree of turbulence of the recirculation flow is very low (below the lowest value for any conventional combustor). As a result, no particulate carbon is formed in the vortex. The favorable consequence of this is the absence of high thermal radiation losses from the recirculation flow to the combustor wall and a relatively low temperature of the combustor wall within the area from the point of separation of the recirculation flow from the flow of the combustion products that leave the combustor to the inlet area. It should be noted the combustor wall temperature upstream the separation point does not have any substantial effect on CO levels.

The process of heat exchange between the vortex surface and the chemically reactive fuel and air mixture is not determined by the temperature fields only; it also depends on the chemical makeup of the vortex and the fuel and air mixture. There is a difference between the temperatures of the two flows (the vortex temperature is higher) and a difference between their chemical composition (the vortex contains more $CO_2$ and $H_2O$, and the fresh mixture contains more fuel and oxygen). Therefore, if the two flows move in the same direction without mechanical mixing, conditions for diffusion processes are created, more specifically, for the thermal diffusion and concentration diffusion. The barometric diffusion is negligible, and it would be important only at the transition to a controlled explosive combustion.

The ratio between the thermal diffusion and concentration diffusion varies during operation of the combustor; however, the concentration diffusion will always prevail in the heat exchange between the vortex and the fuel and air mixture. The concentration diffusion actually has a decisive effect on the heat exchange process intensity. It is problematic to assess the actual concentration gradient during the heat exchange if chemical reactions should be factored in. It should be noted that a change in concentration of $CH_4$ (or other fuel) and $O_2$ in the interfacing layers of the vortex flow and the fuel and air flow influences not only the thermal energy transfer process, but also the reaction direction (direct and reversed). If, for example, $CH_4$ concentration in the fuel and air mixture increases (as a result of a coefficient of equivalence increase compared to the design setpoint value), fuel reforming processes will start prevailing in the interface layers. This, in combination with specifics of oxygen supply to the vortex, will result in the vortex peripheral temperature decrease, and as a consequence, the temperature of molecules that get to the central part of the vortex will also come down. Both processes, which occur simultaneously, would result in a decrease in the vortex temperature to a sub-critical value, resulting in a flameout. This is why the problem of stable combustion of a lean mixture could not be resolved by simple mechanical mixing of the vortex flow and the fuel and air mixture flow as it has been done before because thermal energy supply to the fuel and air mixture in such case is accompanied by a concurrent increase in the $CO_2$ and $H_2O$ supply (resulting in intensified fuel reforming), with a decrease in temperature of the vortex and fuel and air mixture. According to the invention, the diffusion process prevails between the two flows (without their mechanical mixing), and the source of thermal energy at the inlet where the flows meet (the vortex) has an increased velocity with respect to the velocity of the thermal energy consumer, the fuel and air mixture.

The intensive vortex to fuel/air mixture heat transfer initiates the thermal nozzle effect in the following manner. The peripheral layer of the flow of fuel and air mixture will always receive thermal energy from the vortex periphery at a high heat transfer rate as well as "hot" molecules of $CO_2$, CO, and $H_2O$. Thus conditions for firing the periphery of the fuel and air flow and sustaining combustion of this layer are provided. As soon as this peripheral layer is fired, combustion propagates at a very high speed through the entire body of the fuel and air flow, and the flow velocity starts rising under the thermal nozzle effect. As a result, the kinetic energy of the fuel and air flow increases. The steady burning (stable flame) of the fuel and air flow peripheral layer is assured not only by the high temperature of the vortex flow and the high rate of heat transfer from the vortex periphery to the fuel and air flow periphery, which forms a kind of a "pilot flame." The continual and sufficient supply of the molecules of $CO_2$, CO, and $H_2O$ to this "pilot flame" layer assures sustained flame under any transients, with minimum fuel-to-air ratios, and under sudden fluctuations of fuel supply.

Molecules of fuel and oxygen move in opposition to the "hot" molecules that move from the vortex into the fuel and air mixture by diffusion. This is the concentration diffusion. Nitrogen molecules diffuse from the vortex into the fuel and air mixture in a very small quantity (thermal diffusion), and nitrogen for the most part does not move from the fuel and air mixture into the vortex because nitrogen concentrations in the vortex and fuel and air mixture are substantially equal. A part of the fuel that gets into the interface layer between the vortex and flow and fuel and air flow is fired, whereas the major part of the fuel in that layer is being reformed. The primary ("hot") CO molecules, as well as a part of hydrogen, remain in the interface layer.

Some molecules that remain are oxidized to $CO_2$ and $H_2O$ which return to the fuel and air mixture. The major part of the primary ("hot") CO molecules and hydrogen return to the fuel and air mixture in the form of CO and $H_2$. They form the "striking force" of the vortex. The "cold" molecules (obtained as a result of reforming), so-called secondary CO, $H_2$ as well as oxygen, will move to the center of the vortex (they have lower inertia because of a lower thermal motion velocity). Not all of them will make it to the center. A part of them will be oxidized to $CO_2$ and $H_2O$ on their way to the center, which will return by the centrifugal forces to the vortex periphery (by the inertial diffusion), and so on.

Figure 1:
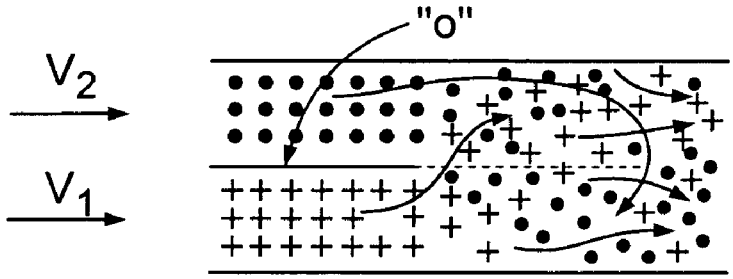
FIG. 1 schematically shows the interface between a flow of fuel and air mixture and a recirculation vortex flow in a combustor according to the invention.
Figure 1A:
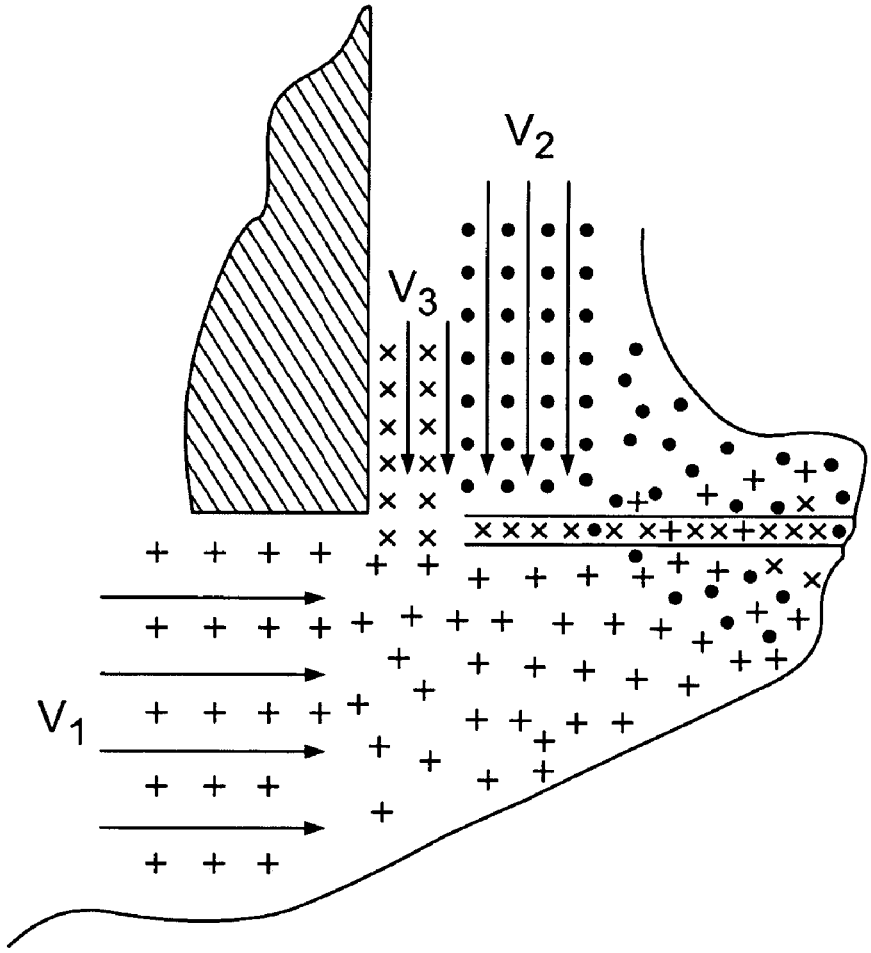
FIG. 1A schematically shows part of the interface layer between the recirculation vortex flow and the incoming fuel and air mixture flow, in which X symbol represents "hot" CO molecules in the peripheral layer of the recirculation vortex flow.

This process is illustrated in FIGS. 1 and 1A, in which dots represent "hot" CO, $CO_2$, $H_2O$, and $H_2$ molecules, and pluses represent "cold" fuel molecules and oxygen. The arrows show directions of molecule movement as described above, and the point at which the recirculation vortex flow and the incoming fuel and air mixture flow meet is shown at "O."

An enlarged, schematic, partial view of the interface layer between the recirculation vortex flow and the incoming fuel and air mixture flow is shown in FIG. 1A. The "X" symbols represent CO formed by reformation, carried in the peripheral layer of the vortex. The figure shows the CO diffusing into the incoming fuel and air mixture in the inlet zone, greatly assisting combustion. As should be understood, although the velocity V2 of the recirculation vortex flow is greater than that of the incoming fuel and air mixture flow V1, the velocity V3 of the peripheral layer of the recirculation vortex flow is much slower than that of the incoming fuel and air mixture flow (there is a velocity gradient from the surface, and the average velocity in this layer is in the range of approximately ⅕ of V1).

Figure 2:
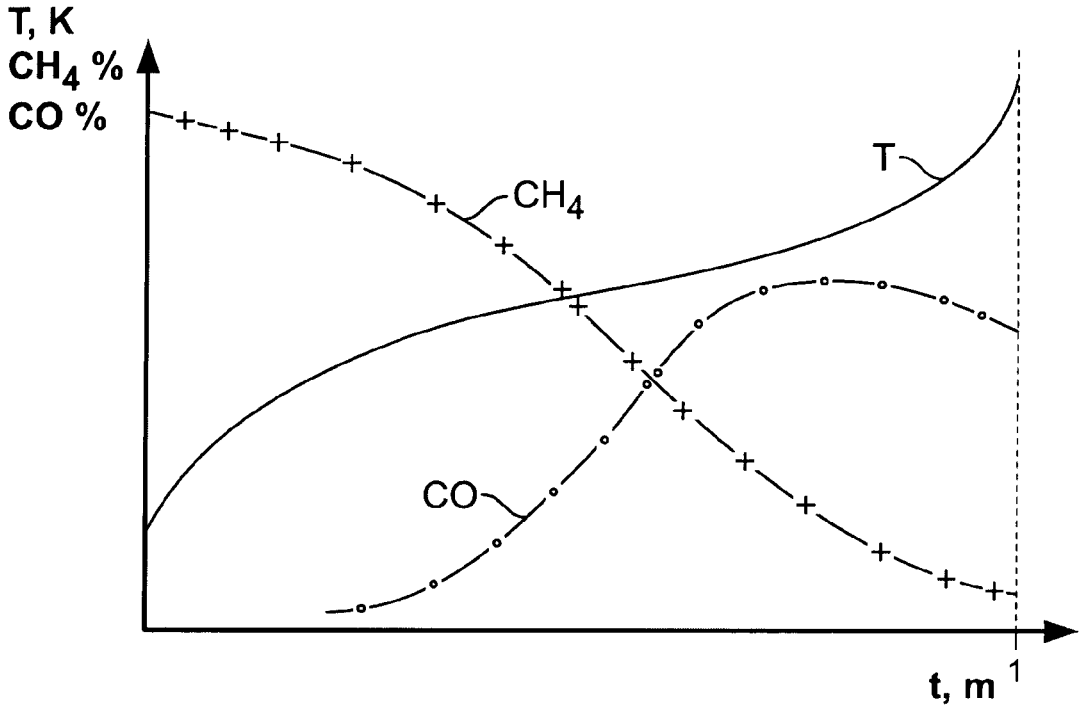
FIG. 2 is a chart showing $CH_4$, T and CO versus the contact time between the recirculation vortex flow and the fuel and air mixture flow ion a combustor according to the invention.

The processes occurring in the interface layer are illustrated in the chart of FIG. 2. It can be seen that the fuel level ($CH_4$) drops with time, but the temperature (T) remains almost unchanged (it does not increase as it normally would in conventional combustors) because intensive fuel reforming is going on, with formation of both "cold" and "hot" CO molecules. The temperature T starts rising approximately after a lapse of approximately ⅔ of the contact time, or, in this embodiment, about 0.7 to 0.8 ms after the two flows meet.

The currently preferred way to carry out the combustion method according to the invention is to have a combustor designed to meet the following dimension proportioning:

$$a \geqq 1.4\ b$$

$$d \leqq 2.2\ b$$

$$2r+b \geqq c \geqq r+b$$

wherein:

r is the radius of the circular surface (see FIG. 6);

a is the distance between the inlet and the exit of the combustion space;

b is the inlet section height;

c is the maximum dimension of the combustion space in the direction of the radius r;

d is the exit section height.

If d is greater than 2.2 b, the thermal nozzle cross-sectional area will be too large, and the desired fuel and air flow velocity that imparts the initial impulse on the vortex will not be achieved. If c is greater than 2r+b, the cross-sectional area will be too large, the desired fuel and air flow velocity will not be achieved, its effect on the vortex will be reduced, and the vortex velocity in the area of its interface with the fuel and air flow will be too low. Preferably, the cross-sectional area of the exit is no more than 2.2 times the cross-sectional area of the inlet. When it is desired to change into the operating mode in which the reactor functions as a reformer, the inlet cross-sectional area is reduced relative to the inlet cross-sectional area used in the operating mode in which the reactor functions as a combustion chamber.

The dimension a determines the vortex and fuel and air flow contact time. Preferably, this time should be longer than about 1 ms. The dimension a can be obtained based on the inlet velocity of fluid at the inlet, preferably, of 10 to 20 m/s.

Figure 3:
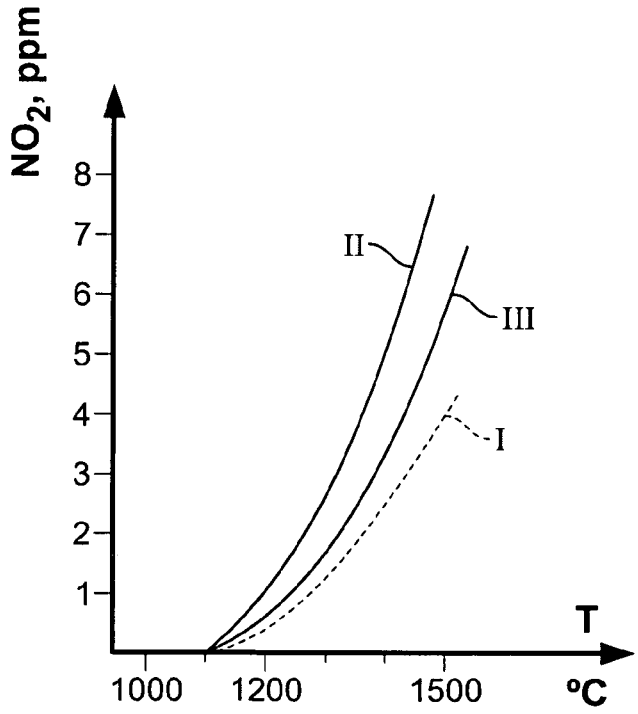
FIG. 3 is a chart showing $NO_x$ emission levels versus combustion temperature.

When fresh fuel and air mixture is heated (with temperature rise of about 150° C.), which normally takes place when the mixture is heated with recirculated hot gases in a conventional combustor before ignition, there is normally a non-uniformity of temperature profile within the fuel and air flow. The temperature non-uniformity can be as high as 100%, which means that individual jets of the flow may remain practically at the same temperature as the air flow temperature before entering the combustor. The temperature non uniformity will be about the same at the end of the fuel combustion. If the combustor exit temperature should be about 1200° C., temperatures within the flow can be as high as 1500° C. because of the above-mentioned non-uniformity. While $NO_2$ levels at 1200° C. may be acceptable, nitrous oxide emissions at high temperature are substantially higher. This is illustrated in FIG. 3, where Curve I shows nitrous oxide emissions for a hotter layer of the fuel air mixture and Curve II shows nitrous oxide emissions for a colder layer of the fuel air mixture. It can be seen that $NO_2$ can be on the level of 1 ppm and 10 ppm and higher in the same combustor. Curve III shows a case for uniform temperature profile in the fuel and air mixture heated before ignition.

Attempts to eliminate the temperature non-uniformity by bringing more hot gases to the fresh fuel and air flow result in the fact that the part fuel and air mixture that receives more hot combustion products will be heated to a lower temperature than the rest of the mixture receiving less combustion products contrary to what might be expected. This is explained by the fact that excessive quantities of hot combustion products cause more intensive fuel reforming, which is the cause of temperature reduction. This phenomenon becomes more pronounced with poor mixing of fuel and air, so the areas of the flow with higher fuel levels will drop in temperature even lower because of higher reforming rates. This can be seen in FIG. 4 that shows temperature in the fuel and air mixture flow versus the vortex periphery velocity. It can be seen that the temperature rise in the fuel and air flow increases until the vortex periphery velocity becomes 1.2 to 1.25 times the inlet fluid flow velocity, after which point the temperature goes down, and this in spite of large amounts of thermal energy injected into the inlet fluid flow.

It will be, therefore, apparent that the above-described temperature non-uniformity remains within the fuel and air flow up to the moment of ignition. When the fuel and air mixture ignites, the colder parts will burn out earlier and become hotter than the part that was hotter before ignition. With vortex periphery velocities, which are desirable to reduce emissions, the temperature non-uniformity within the burning fuel and air mixture (after ignition) will become even higher because of the above-described reforming effect. This is explained by the fact that the hotter parts of the fuel and air mixture will be still burning after the burning of the colder part of the mixture have been completed. The temperature non-uniformity at this time may be as high about 500° C.

The above-mentioned difference between the combustion processes is explained by different chemistry of combustion in the flow jets having different temperatures. Since the colder jets contain more combustion products, the rate of CO oxidation in these jets is determined by the first-order chemical reaction equation well known to those skilled in the art:

$$x=a_1-b_1[\exp(-kt)] \quad (1)$$

wherein:

x is the current CO level in combustion products (mol);

$a_1$ is the initial CO level (mol);

k is the kinetic constant of reaction (2.15 mol/s);

$b_1$ is the temperature coefficient;

t is the combustion time (s).

The hotter jets of the flow, which contain less combustion products, burn according to a second-order chemical reaction equation, which reflects the effect of the diffusion mass transfer on the combustion process in such jets:

$$x=a_2-b_2[\exp(-kt)]+D\mathrm{eff}[\exp(-mt^2)], \quad (2)$$

wherein:

x, $a_2$, $b_2$, k, and t have the same meanings as x, $a_1$, $b_1$, k, and t;

Deff is the effective diffusion coefficient (mol/cm$^2$*s);

m is the coefficient of non-binary collisions (cm$^{-1}$*s$^{-1}$).

Figure 5:
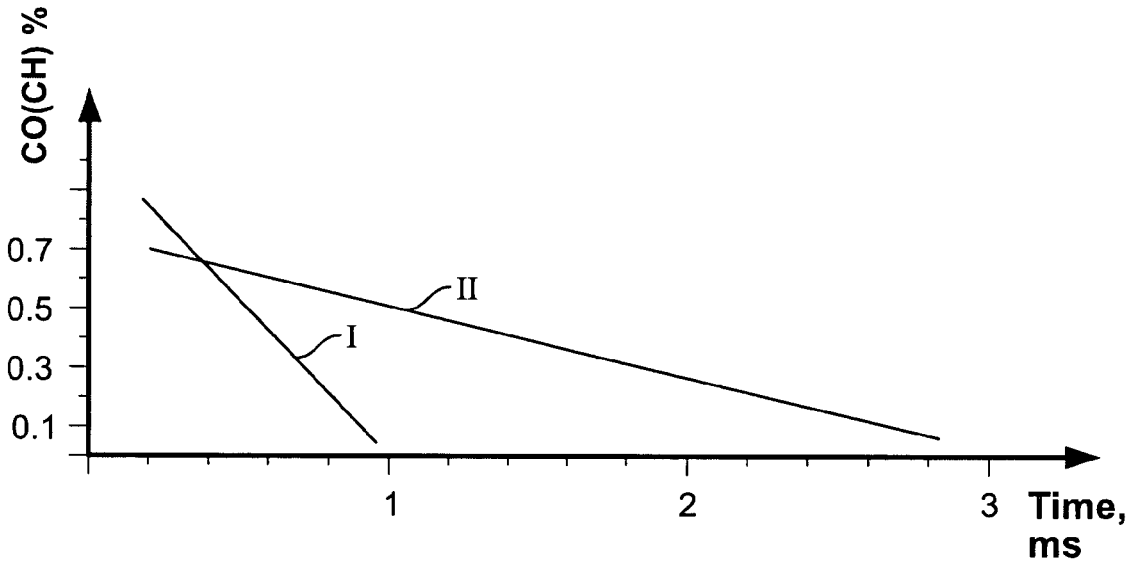
FIG. 5 shows concentrations of CO and CH (%) versus combustion time.

The workings of these two equations are explained with reference to FIG. 5 showing concentrations of CO and CH (%) versus combustion time. Curve I represents the kinetics that is described by equation (1), and it can be seen that the fuel burns out rapidly, with a short combustion time, which is good for lowering $NO_x$ emissions, with minimum CO levels at the same time. Curve II illustrates the kinetics described by equation (2), and it can be seen that the combustion process takes much longer than in the former case, which, coupled with a higher combustion temperature, gives rise to high $NO_x$ emissions and very slow CO burn-out. It should be noted that Curve II is given with the assumption of a homogeneous fuel and air mixture, which is an ideal case. With fuel and air mixing obtainable in prior art combustors, the result will be much worse.

To eliminate the above disadvantages of the prior art, it is necessary to raise the temperature of the main air flow at the very entry to the combustion zone, uniformly over the cross section the inlet where the fluid flow is admitted to the combustor. It is important that substantially the entire body of the incoming flow has received substantially the same amount of thermal energy before entering the combustion zone. If this is the case, the fuel reforming conditions over the entire body of the fuel and air mixture will be substantially the same.

The advantage of this method is as follows. Since the ignited flow did not have temperature non-uniformity before ignition of the fuel and air mixture, the combustion occurs substantially at the same temperature over the entire body of flow, and in this case, the maximum design setpoint temperature at the combustor exit will be, for example, 1200° C., and the temperature cannot be above this level at any point within the combustor. It is known that this is the temperature of minimum $NO_2$ formation and most intensive CO burn-out. This allows a combustor to be designed for the combustion temperature that equals TIT when used in a gas turbine engine. The uniform temperature profile in the combustion zone assures absence of hot spots and locally overheated combustor areas, thus making the combustor cheaper and simpler to fabricate and extending combustor life.

Figure 4:
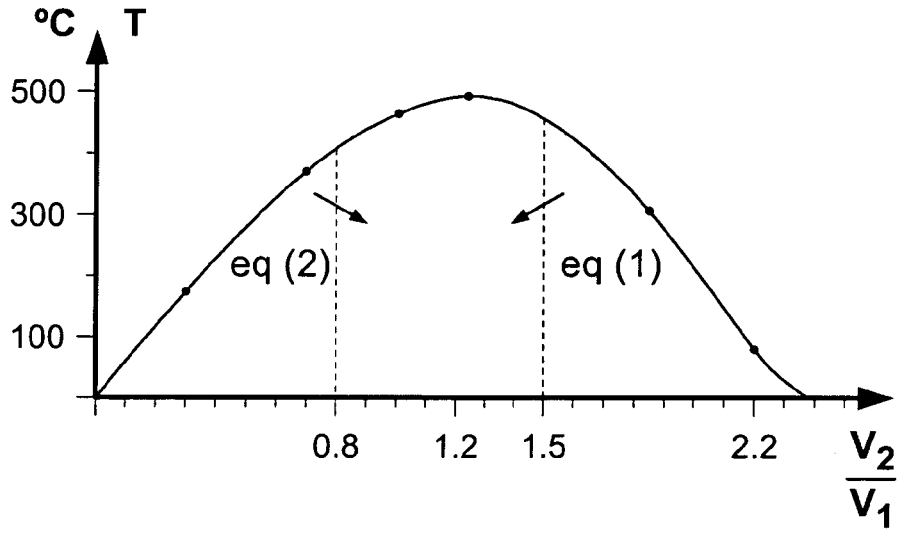
FIG. 4 shows temperature in the fuel and air mixture flow versus the ratio $V_2/V_1$.

The uniformity of temperature profile in the incoming flow allows the combustor to work well using either equation (1) or equation (2). As shown in FIG. 4, with the vortex periphery velocity of up to 1.2 times the inlet fluid flow velocity, the combustion process occurs predominantly per equation (2) with low $NO_x$ emissions at the combustor exit and relatively low CO emissions. With the velocity ratios between 1.4 and 2, both $NO_x$ and CO emissions at the combustor exit will be low (see FIG. 5).

It is preferred that the temperature of air for combustion be raised by 50° C. to 550° C. in the inlet zone. If the CO emission requirements are not too strict, the higher temperature rise can be used, which greatly simplifies the combustor design. In this case, equation (2) will determine combustor operation, and the process will not require high quantities of the recirculated hot gases, which lowers thermal load on combustor components. If the CO level is required to be low, then the temperature rise can be lowered, but the ratio of the vortex peripheral velocity in the area proximate the inlet but outside of the boundary layer to the velocity of the incoming main flow entering the main flow zone should be increased, working within the range of 1.4 to 2.2. In this case, the combustor works per equation (1), again with low $NO_x$ emissions, and CO levels are remarkably reduced as shown by Curve I in FIG. 5.

The ratio of the vortex periphery velocity in the area proximate the inlet but outside of the boundary layer to the velocity of the incoming main fluid flow entering the main flow zone ranges from 1.4 to 2.2. As shown above, there is a relationship between this ratio and the temperature rise in the inlet fluid flow. As can be seen in FIG. 4, there are two areas, one dominated by equation (2) and the other dominated by equation (1). A transition area approximately between the ratio values 0.8 and 1.5 is described by both equations, (1) and (2), in which the $NO_x$ levels will be higher than the levels in both left hand and right hand area, and the CO level will be higher only compared to the right hand area. This transitional area will occur, e.g., under transients, and it can be eliminated, e.g., by changing the velocity ratio (e.g., by changing the inlet cross-section or the angle β at the separation point).

The combustor according to the invention may be made with a turbulizer positioned downstream from the exit of the combustion space to improve conditions for residual CO oxidation. In such case, the combustor can work according to equation (2) with a lower combustion temperature and still have good CO emission performance. The same facility can be used when working according to equation (1) in order to further reduce the CO level.

FIG. 6 shows a combustor according to the invention as applied to a burner, a cross-sectional view. As shown in FIG. 7, the combustor has an elongated design, and it can be made of a length required to cover, e.g., a furnace wall for a boiler plant. The combustor shown at 10 has a casing defined by a wall 12 (which can also function as a liner). The wall 12 and end walls 14 (only one, right hand wall 14 is shown in FIG. 7) define a combustion space 16, in which combustion of fuel takes place. The combustion space 16 has an inlet 18 and an exit 20 spaced from each other, and it is understood that fluid (e.g., air under pressure) is admitted with a velocity $V_1$ to the combustion space 16 through the inlet 18 and moves through the combustion space 16 in the direction toward the exit 20 to be used in a device (not shown) positioned downstream of the combustor 10. According to the invention, the combustion space has a circular wall 21 defining a path for a recirculation vortex flow, which is separated from the fluid flow that is discharged through the exit 20 of the combustion space 16. A part of the fluid flow is separated from the fluid before it has been discharged from the combustion space 16 through the exit 20 at a separation point 22, and the circular surface 21 extends between the separation point 22 and the inlet area 24 within which the inlet 18 is located. The term "circular" is used here to mean "having an exact or approximate form or outline of a circle" (Webster's Third New International Dictionary of the English Language, Merriam-Webster, Inc.). It is understood that the exact circle is preferred for the purposes of the invention, but a shape approximating a circle such as an ellipse or the like can also be used to achieve the objectives of the present invention. The inlet fluid flow moves through the combustion space 16 along a path shown with a line O—O. The angle $\alpha$ between the direction of movement of the inlet fluid flow and a portion 26 of the wall 12 at the inlet 18 or the direction of the recirculation vortex at the inlet 18 is preferably between approximately 85° and 175°, and it is shown here as a right angle. This function of this angle will be described below. The angle $\beta$ between the direction of movement of the inlet fluid flow O—O and the tangent plane T—T to the wall 12 at the separation/take off point 22 or the direction of the recirculation vortex at the take off point 22 is preferably between approximately 100° and 15°. The function of this angle will be explained below. The dimensions a, b, c, d, and r are explained above in the description of the combustion method according to the invention.

This combustor functions in the following manner. Fluid such as air for combustion is admitted through the inlet opening 18, e.g., from a blower or compressor, and it will be understood that air can be admitted with fuel already premixed, or fuel can be supplied independently into the fluid flow at the inlet (not shown). This fluid admitted through the inlet 18 moves in a general direction O—O toward the exit 20 from the combustion space 16, and the initial velocity of this fluid flow is $V_1$. Fuel is ignited by means of an igniter (which is not shown and which can be installed, e.g., upstream from the inlet 18 or within the combustion space 16) and starts burning within the combustion space 16, resulting in formation of hot combustion products, which are discharged through the exit 20, e.g., for use in a boiler or any other heat exchange device.

Preferably, the igniter should not be disposed within the recirculation vortex, to avoid interfering with the flow in that area. In a can combustor embodiment, cross-fire tubes may connect the cans at a point on each can beyond the recirculation area, or before the recirculation area (but not inside the recirculation area as is sometimes conventionally practiced). Alternately, the igniter could be disposed even within the recirculation chamber if it is adapted so as not to substantially interfere with the flow. Before the combustion products (hot gases) leave the combustion space 16, a part of them separates at the separation or take off point 22 from the main flow moving generally along the line O—O, to form a recirculation vortex flow shown by arrow 28 in FIG. 6. This flow has a velocity $V_2$ which depends on the ratios between the internal dimensions of the combustion space 16 and also on the character of the recirculation vortex flow along the circular surface 21. With angle $\beta$ between the direction of movement of the inlet fluid flow O—O and the tangent plane T—T to the wall 12 at the separation point 22 of 45°, the degree of turbulence of the vortex flow along the circular surface 21 will be about 0.008, and if the angle $\beta$ is about 100°, the degree of turbulence will be about 0.2. The preferred value of the angle $\beta$ is about 65° for a degree of turbulence of about 0.03 to 0.025. It will be understood that the above-given low values of the turbulence degree can be obtained only if the circular surface 21 (at least over the major portion of its surface starting from the separation point 22 and extending in the direction toward the inlet 18) is made smooth, i.e., without any holes, recesses, protrusions, fluid inlets, and the like. Any such irregularities in the surface would positively and inevitably disturb the vortex flow along the surface 21, turbulize it, and raise the degree of turbulence in excess of the above-mentioned limits, to 0.2 and even higher, making it similar to what is taking place in conventional trapped vortex combustors. The degree of turbulence may be increased (within the above-specified limits) in order to increase the vortex temperature when the application requires. The angle $\alpha$ is selected within the range from 85° to 175° based on the conditions under which the recirculation vortex flow meets the inlet fluid flow in the zone 24 of the inlet 18. An increase in the value of this angle results in a lower turbulence of the two flows when they meet. When the recirculation vortex flow having a velocity $V_2$ meets the inlet fluid flow having a velocity $V_1$ in the inlet zone ($V_2>V_1$), the two flows define an interface layer between them as described in detail above to illustrate the processes occurring in the combustion space 16. It will be understood that the velocity $V_2$ is greater than the velocity $V_1$ as described above because of the thermal nozzle effect described above, and because of the low degree of turbulence along the circular surface 21 and absence of turbulizing elements along this path, and the high velocity $V_2$ remains higher than the velocity $V_1$ until the moment the two flows meet in the inlet zone.

Figure 8:
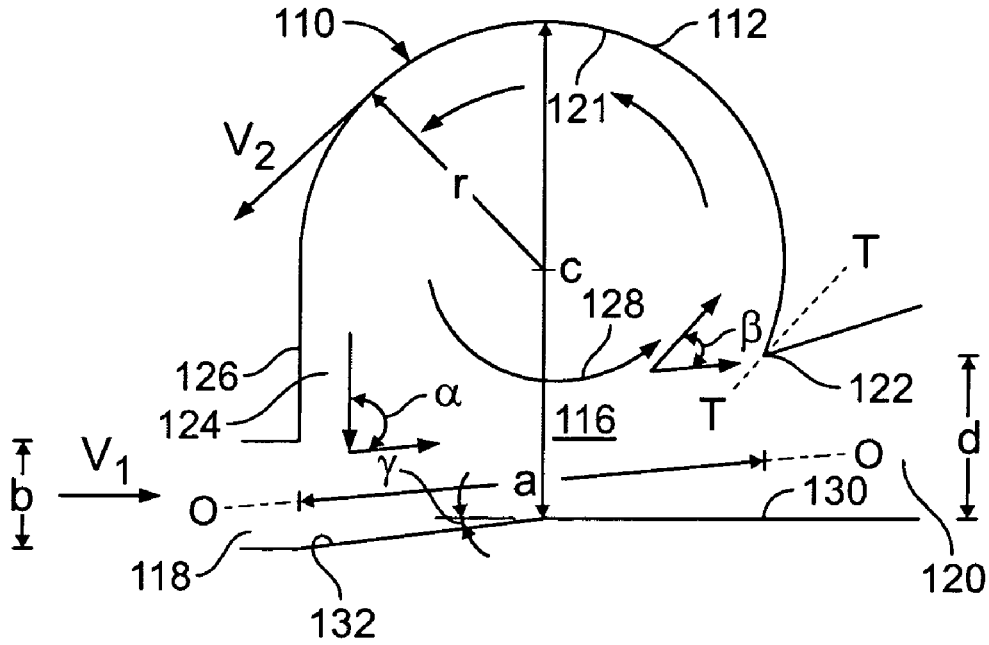
FIG. 8 is a schematic partial sectional view of an annular combustor according to the invention.

FIG. 8 shows a schematic partial sectional view of an annular combustor according to the invention, with the identical parts shown at the same reference numerals as in FIGS. 6 and 7, with addition of 100. In this embodiment, the surface 130 along which the inlet fluid flows has a portion 132 at the inlet 118, which is inclined with respect to the general direction O—O of the inlet fluid flow at an angle $\gamma$ of approximately 0° to 15°. This design can be used in applications where it is required to maintain the ratio between the velocities $V_1$ and $V_2$, and the combustor radial size is limited. In such case, the velocity $V_1$ cannot be lowered by increasing the inlet cross-sectional area by simply enlarging the dimension b because this would result in the inlet flow interfering with the low-turbulence recirculation vortex flow. By using the angle $\gamma$ that is greater than 0°, the dimension b is left practically unchanged, but the flow cross-sectional area is made larger, without interfering with the recirculation vortex flow. For the rest, this embodiment functions along the lines of the embodiment described above with reference to FIGS. 6 and 7.

Figure 9:
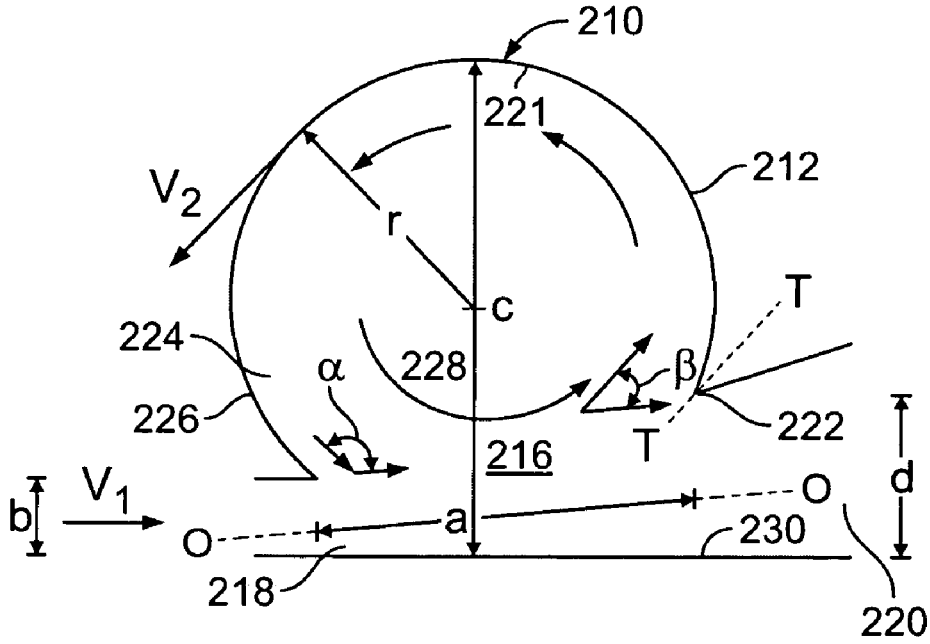
FIG. 9 is a longitudinal section view of another embodiment of an annular combustor designed along the lines of FIG. 8.

FIG. 9 is a longitudinal section view of the annular combustor designed along the lines of FIG. 8, with the identical parts shown at the same reference numerals as in FIGS. 6 and 7, with the addition of 200. The difference here is that the angle $\alpha$ is made bigger, providing very soft low-turbulence conditions for the two flows (the recirculation vortex flow and the inlet fluid flow) to lower the CO level.

Figure 10:
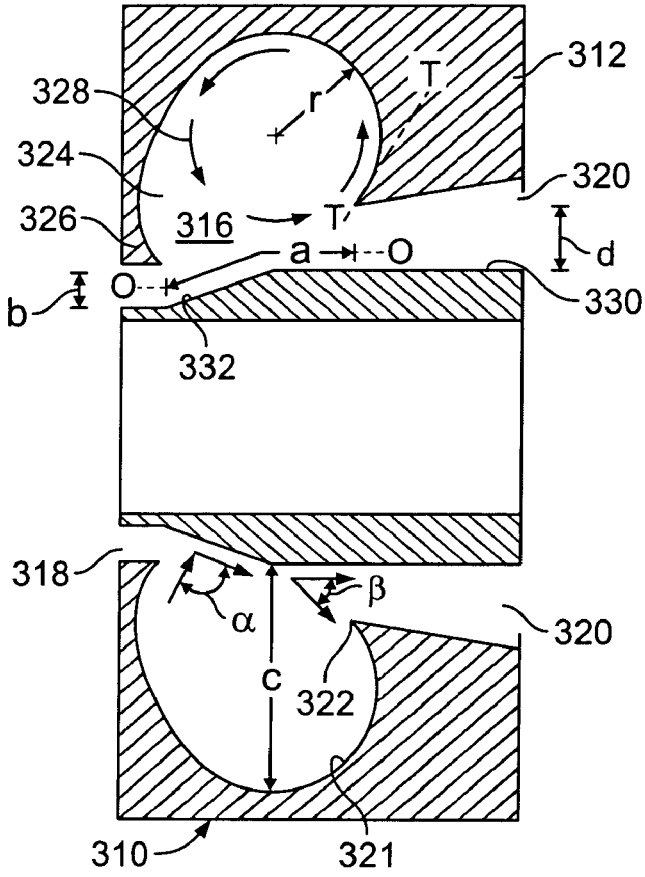
FIG. 10 is an embodiment of the combustor shown in FIG. 8.

FIG. 10 shows an embodiment of the combustor shown in FIG. 8, with the identical parts shown at the same reference numerals with the addition of 300, to illustrate how the embodiments of the combustor shown in FIGS. 8 and 9 are used together. It can be seen here that the angle $\gamma$ is greater than 0°, and the angle $\alpha$ is greater than 90°. With the combustor according to the invention that is so designed, the CO level can be reduced with a small radial size of the combustor.

Figure 11:
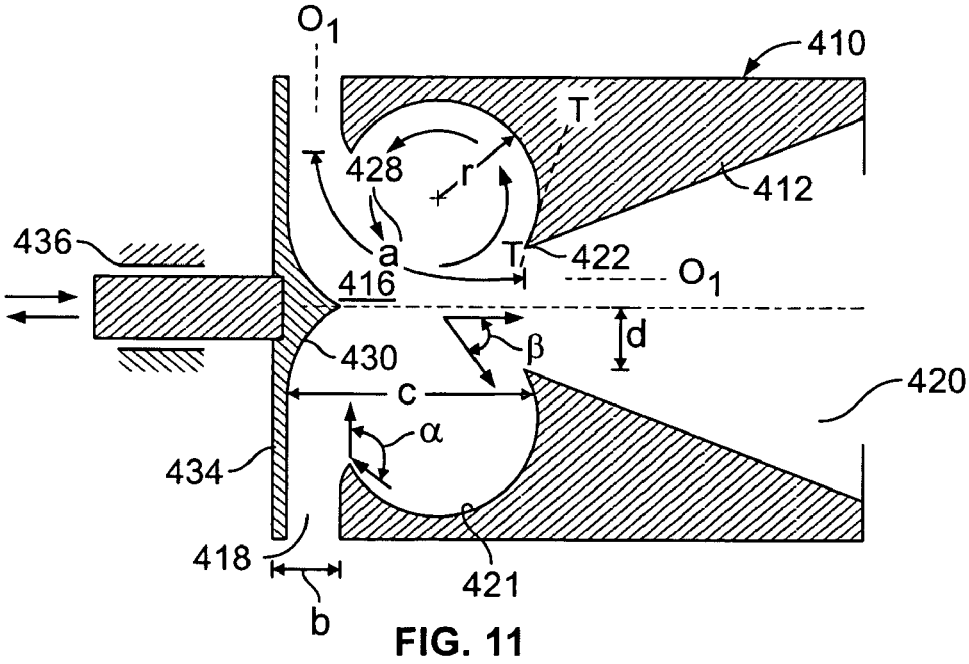
FIG. 11 is a schematic longitudinal section view of a can combustor according to the invention.

FIG. 11 shows a can combustor designed according to the invention. The identical parts are shown at the same reference numerals with the addition of 400. The difference here is that the inlet flow is admitted in the radial direction and moved along a curved path $O_1$—$O_1$. The wall 434 that defines the surface 430 can be moved in and out (left to right or vice versa in the drawing) in a guide sleeve 436. This allows the same combustor to be used in different applications because by changing the inlet conditions, the ratio of the velocities $V_1$ and $V_2$ can be changed, thus changing the combustor design point maximum temperature. The wall 434 can be also arranged to move during operation of the combustor (by means of a mechanism that is not shown), and in such case, the combustor maximum temperature can be varied, e.g., depending on load conditions.

Figure 12:
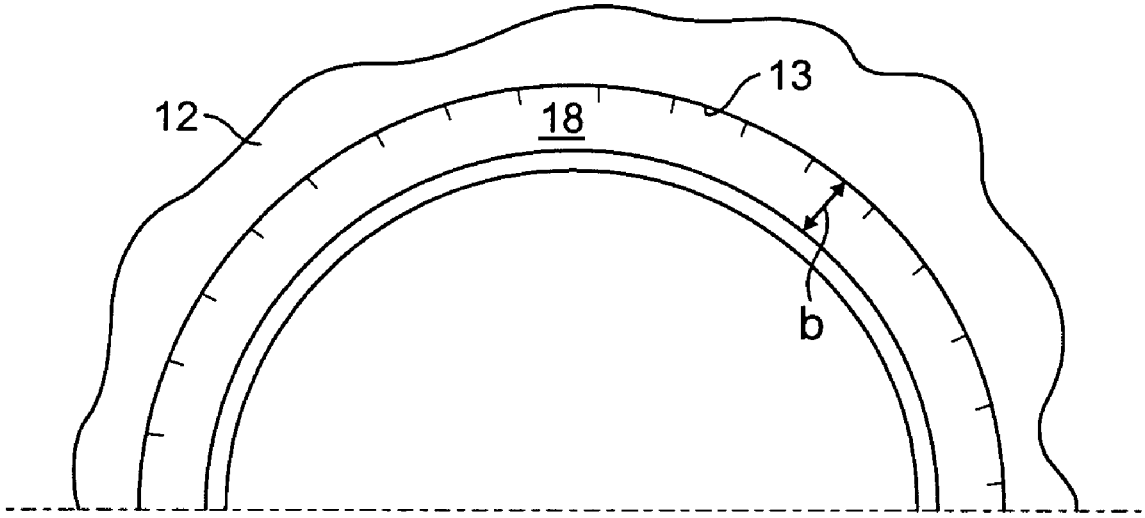
FIG. 12 is an end view of a combustor according to the invention looking at the inlet side, showing an embodiment of the inlet opening.
Figure 13:
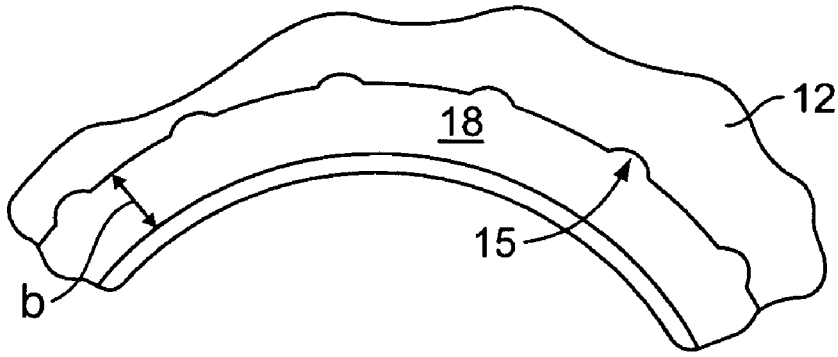
FIG. 13 is another embodiment of the inlet opening in the view similar to that shown in FIG. 12.

FIGS. 12 and 13 show embodiments of the combustor according to the invention, with modifications of the inlet 18. As shown in FIG. 12, the inlet opening has radially inwardly extending projections 13 spaced along the circumference of the opening, and in FIG. 13, the inlet opening has radial recess 15 spaced along the circumference of the opening. In both cases, the projections and recesses assure structuring of the peripheral surface of the incoming fluid flow by increasing its surface area. This allows the contact surface area between the inlet fluid flow periphery and the recirculation vortex flow to be enlarged with the same ratio between the velocities $V_1$ and $V_2$ of the two flows. With this arrangement, the combustor can be made shorter, or the interaction between the two flows can be intensified with the same length of the combustor.

Figure 14:
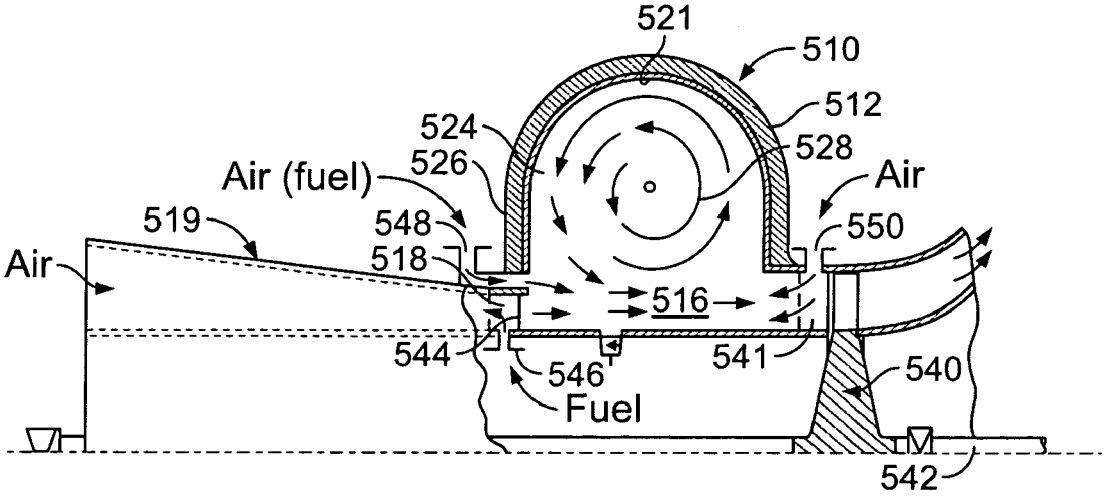
FIG. 14 shows a longitudinal section view of a gas turbine engine incorporating an annular combustor according to the invention.

FIG. 14 shows a longitudinal section view of a gas turbine engine incorporating an annular combustor according to the invention, in which identical parts shown at the same reference numerals with addition of 500. The annular combustor 510, which is generally constructed similarly to the combustor shown and described with reference to FIG. 11, is built in a gas turbine engine, of which a turbine 540 with a set of nozzles 541 is shown, mounted on a shaft 542. Air is supplied to the combustor through a duct 519 from a compressor (not shown) to the inlet 518 of the combustion space 516. The inlet 518 has a diffuser 544, which maintains a residual circumferential swirl that has been imparted to the air flow in order to enhance the interaction between the inlet air flow peripheral surface and the recirculation vortex flow 528 in the combustion space 516. Fuel is admitted to the combustion space 516 through ports 546 for premixing with the air. It is understood that fuel can be premixed with air upstream the combustor. An additional inlet for air and/or fuel is provided in the wall portion 526, in the inlet zone 524 as shown at 548 in order to change the makeup of the recirculation vortex flow just before it meets the periphery of the air flow admitted through the inlet 518. If the combustor is designed to work at a low combustion temperature, say 1000° C., adding air and fuel through the ports 548 will result in raising the temperature to, for example, 1500° C. If, on the contrary, the combustor is designed to work at a temperature of 1500° C., a lower temperature, say 1000° C., can be obtained by supplying additional air through the ports 548. Both air and fuel can be supplied through the ports 548 in controlled quantities and in controlled ratios in order to maintain the combustor at any desired temperature around a certain setpoint under a fluctuating load conditions. The combustor has another inlet for combustion air shown 550 to add fresh air (e.g., oxygen) to the combustion products that are separated from the flow of the hot gases discharged through the exit 520 for use in the turbine 540. If the equivalence ratio is too low, the exhaust flow needs more oxygen to oxidize CO. If the combustor works with an equivalence ratio that is too high, the exhaust flow will contain products of incomplete oxidation of fuel components, CH and CO, and addition of fresh air in this case will enhance the oxidation reactions, even raising the exhaust gas temperature. It should be added that adding air through the ports 550 turbulizes the exhaust flow and enhances CO burn-out. The set of nozzles 541 also turbulize the exhaust flow. It will be apparent that special turbulizers well known to those skilled in the art can also be installed downstream the exit from the combustion space. It will be understood that the above-described steps of adding air and/or fuel through the ports 548 and adding air through the ports 550 can be accomplished by using a control system having load and/or temperature sensors and appropriate control devices to vary, turn ON or shut OFF the additional air and fuel supplies to the combustor using methods and equipment well known to those skilled in the art.

Figure 15:
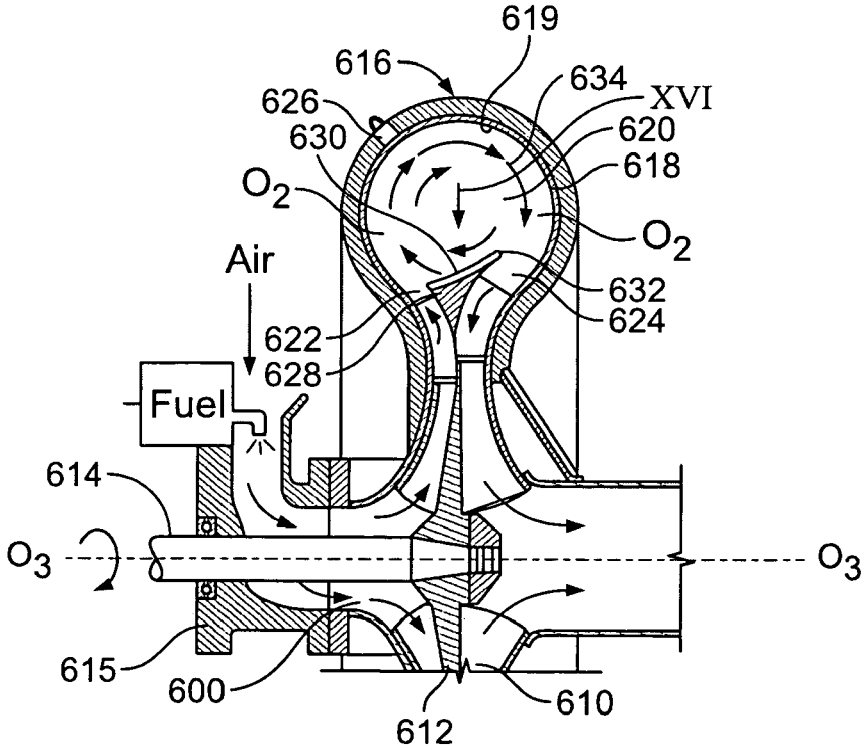
FIG. 15 shows a longitudinal section view of another embodiment of a gas turbine engine incorporating an annular combustor according to the invention.
Figure 16:
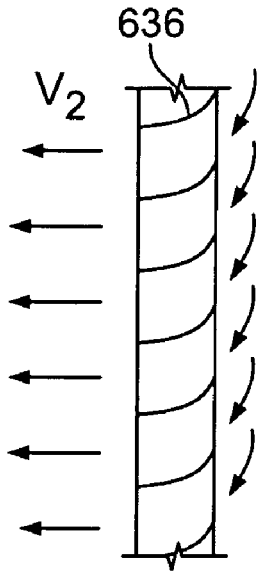
FIG. 16 is a view taken along arrow XVI in FIG. 16.
Figure 17:
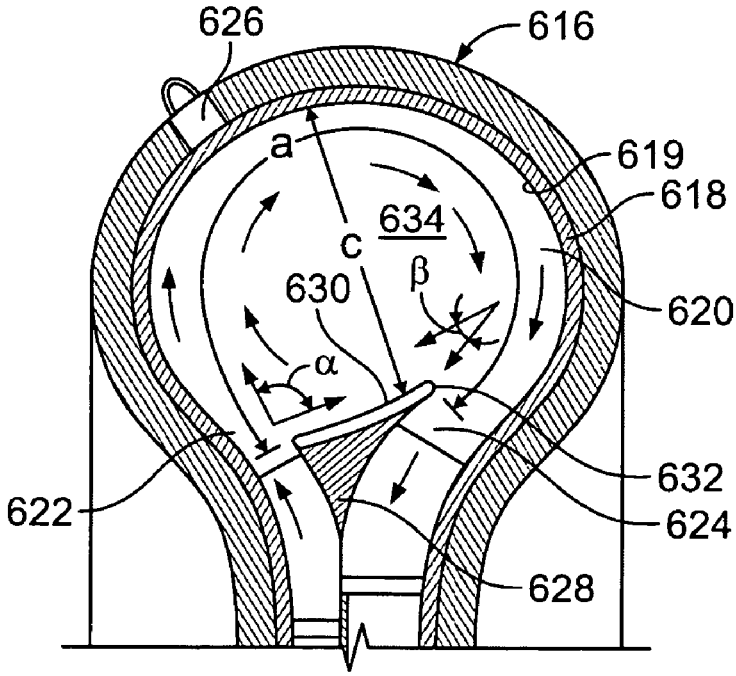
FIG. 17 is an partial enlarged view of the combustor shown in FIG. 15.

FIG. 15 shows a longitudinal section view of another embodiment of a gas turbine engine incorporating an annular combustor according to the invention. This embodiment uses a centrifugal compressor 600 and a centripetal turbine 610 on a common rotor disk 612 mounted on a shaft 614 journalled in a casing 615. A combustor 616 according to the invention has a casing 618 and a liner 619 defining a combustion space 620 that has an inlet 622 on the compressor side and an exit 624 on the turbine side. The combustor has an igniter 626. A separating wall between the compressor 600 and the turbine 610 has a circular surface 630 for recirculation vortex flow, extending between a separation point 632 at the exit 624 and the inlet 622 of the combustion space 620. It will be apparent from FIG. 16 (which is a view taken along arrow XVI of FIG. 15) that a recirculation vortex flow formed by a part of combustion products moving along the line $O_2$—$O_2$, arrow 634, will in this case be located inside the inlet flow moving along the path $O_2$—$O_2$ in the same direction as shown in the drawing. With the vortex flow turbulence conditions being the same as described above for the previous embodiments, the additional advantage here is that this flow moves over a "gas lubricant" provided by the flow of fuel and air mixture, which reduces both hydraulic and thermal losses. As can be seen in FIG. 17, the circular surface 630 is divided into segments by vanes 636 (shown in FIG. 16), which transform the circumferential velocity of the fluid flow about the longitudinal axis $O_3$—$O_3$ of the engine into the vortex velocity $V_2$.

Figure 18:
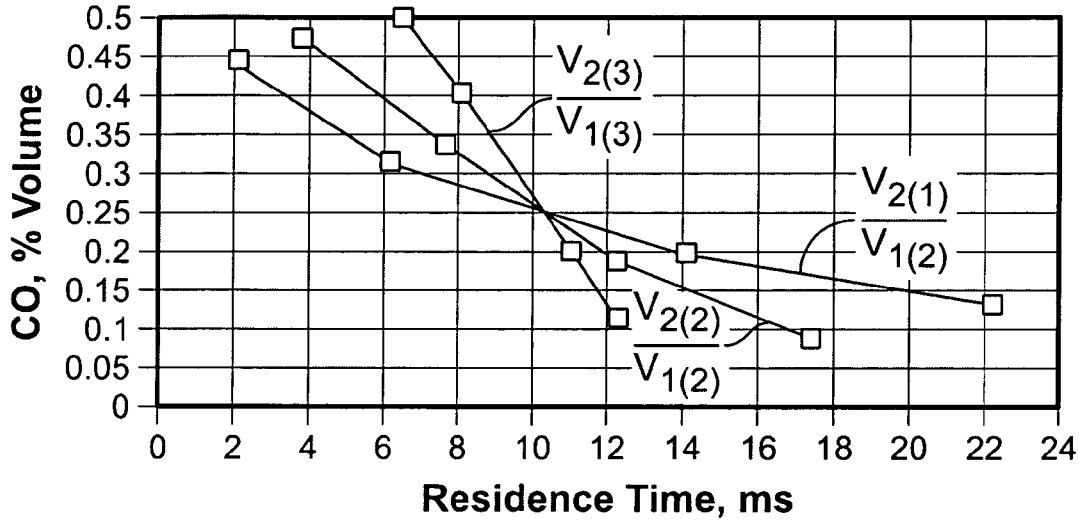
FIG. 18 shows carbon monoxide level (CO) versus the contact time for different ratios of the velocity $V_2$ of the recirculation vortex flow to the velocity of the inlet flow velocity $V_1$.
Figure 19:
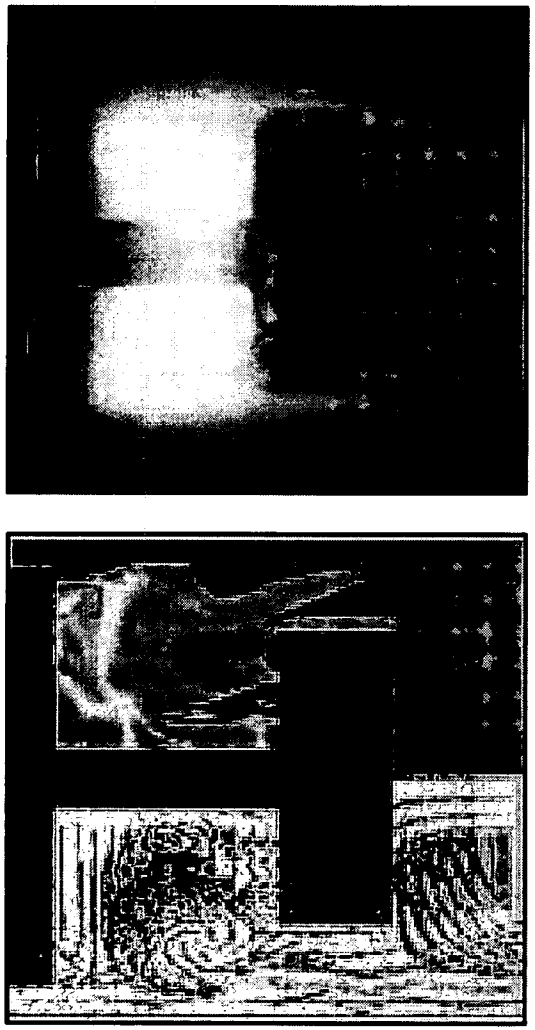
FIG. 19 (Prior Art)
FIG. 19 shows a typical temperature profile for a trapped vortex combustor.
Figure 20:
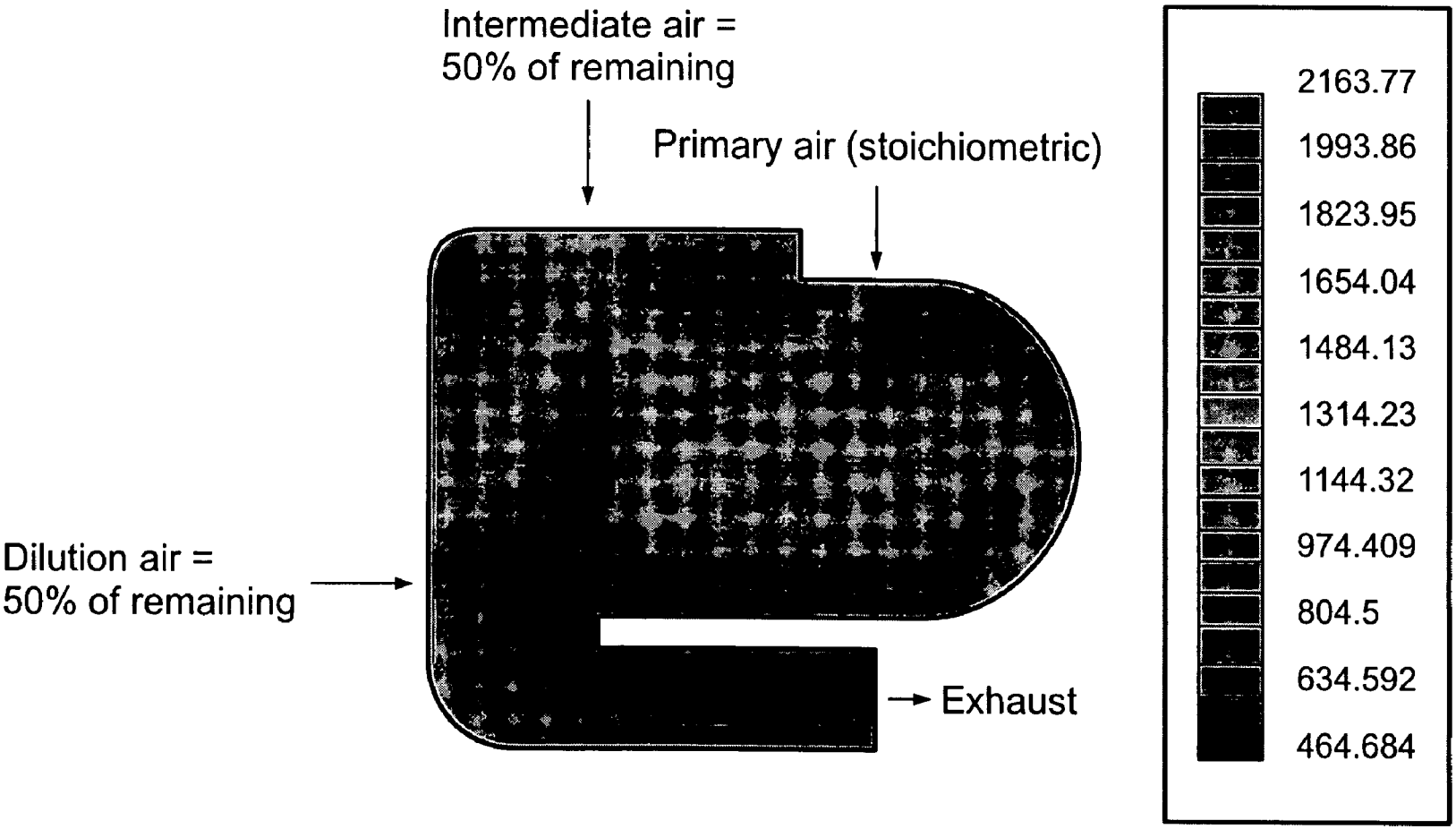
FIG. 20 (Prior Art)
FIG. 20 shows a temperature distribution in a prior art recirculation flow combustor.
Figure 21:
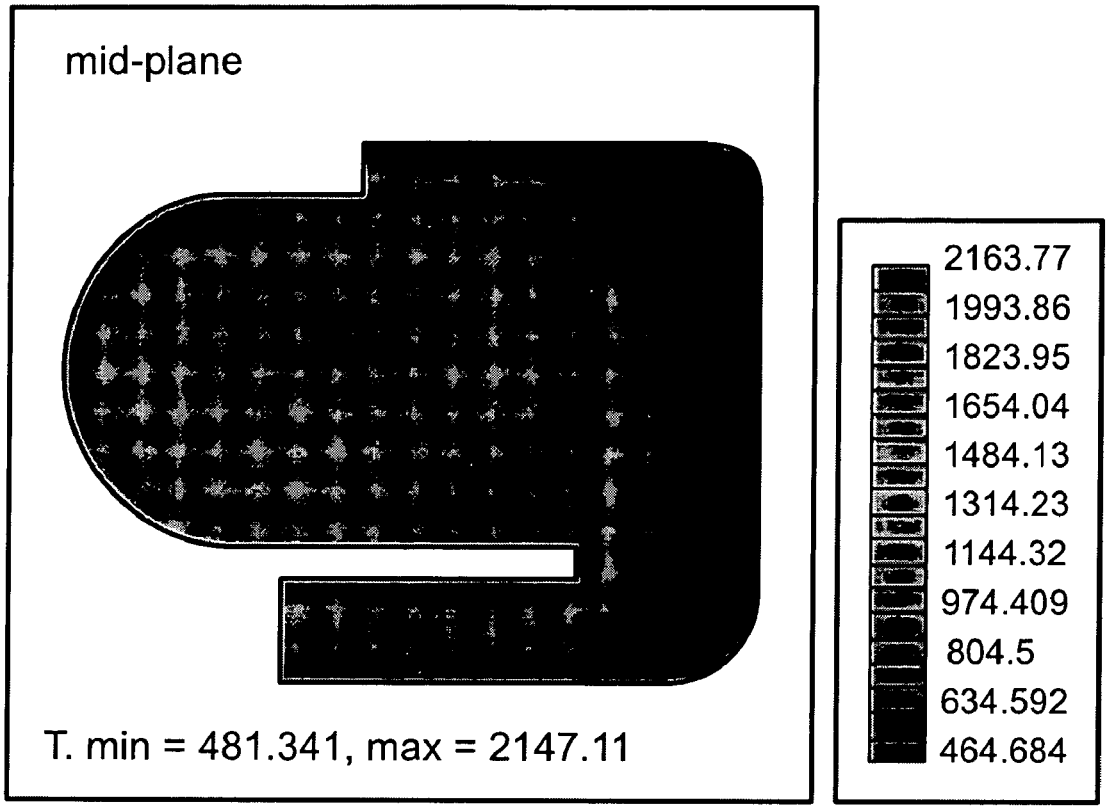
FIG. 21 (Prior Art)
FIG. 21 shows a predicted temperature distribution in a prior art recirculation flow combustor.

It should be noted that the vortex velocity to the inlet flow velocity ratio ($V_2/V_1$) has an effect on the CO level in the exhaust gases. FIG. 18 shows the CO concentration versus residence time (in ms) for three different values of the $V_2/V_1$ ratio. It can be seen that the best solution is to have the highest velocity ratio of, say 2.2, but in this case, the maximum attainable temperature decreases. This means that in applications that require high temperatures at the combustor exit, the velocity ratio should be reduced, with a subsequent increase in the CO concentration. The methods that can be used to control higher CO concentrations were discussed above.

Prototype annular combustors have been fabricated according to the invention and tested. One combustor #1 had a capacity of 760 $cm^3$, and combustion occurred with the maximum possible velocity $V_2$. The maximum temperature in the combustor was about 1650 C. The other combustor #2 had a capacity of 690 $cm^3$, and combustion occurred with a preferred velocity $V_2$, assuring the maximum temperature of about 1260 C. The combustor had the following specifications:

| | |
|---|---|
| Inside diameter | 100 mm |
| Flow | 0.06 kg/s |
| Pressure | 1.2 $kg/cm^2$ |
| $T_{exit}$ | 650–1260° C. |

The tests conducted in burning natural gas gave the following results:

The combustor assured stable ignition without a special starting fuel mixture makeup.

The combustor assured stable cold starting without any preliminary warm-up.

The metal inside the combustor did not show any signs of damage after about 500 starting cycles.

Stable combustion over the entire range of combustion conditions with an equivalence ratios from 0.7 to 0.17.

No visible particulate material was observed in the exhaust during the entire testing period with the equivalence ratios from 0.7 to 0.17.

Some test results are given below.

TABLE 1

Emission tests results for prototype combustor #1 (760 cm3)

| | Combustor exit temperature, ° C. | | | |
|---|---|---|---|---|
| Emissions | 650 | 1,100 | 1,370 | 1,650 |
| $NO_x$ | 0 | 2–3 ppm | 4–5 ppm | 10 ppm |
| CO | 150 | 30 ppm | 12 ppm | 5 ppm |

Note: All data in Tables from 1 to 4 are ref. to 15% $O_2$.

TABLE 2

CO emission tests results for prototype combustor #2 (690 cm3)

| | Temperature, C. | | | | | | | |
|---|---|---|---|---|---|---|---|---|
| | 1,005 | 1,090 | 1,145 | 1,175 | 1,190 | 1,220 | 1,220 | 1,245 |
| CO emission, ppm | 449 | 263 | 93 | 53 | 38 | 15 | 7 | 0 |

TABLE 3

$NO_x$ emission of prototype combustor #2 (690 cm3) (Gas Analyzer 400 HCLD)

| | Temperature, C. | | | | | | | | | |
|---|---|---|---|---|---|---|---|---|---|---|
| | 765 | 875 | 975 | 1,030 | 1,065 | 1,195 | 1,130 | 1,150 | 1,190 | 1,210 |
| $NO_x$, ppm | 1.37 | 1.53 | 1.65 | 1.36 | 1.45 | 1.79 | 1.41 | 1.61 | 1.81 | 1.97 |
| $NO_2$, ppm | 0.11 | 0.06 | 0.07 | 0.03 | 0.03 | 0.05 | 0.04 | 0.02 | 0.05 | 0.08 |

TABLE 4

$NO_x$ emission test results using more accurate API 200A Gas Analyzer; combustor #2 (690 cm3)

| | Temperature, C. | | | | | | | |
|---|---|---|---|---|---|---|---|---|
| | 835 | 940 | 985 | 1,045 | 1,100 | 1,180 | 1,205 | 1,225 |
| $NO_x$, ppm | 1.06 | 1.49 | 1.25 | 0.995 | 0.988 | 1.19 | 1.42 | 1.73 |

The prototype combustors were tested with a fuel having the following composition:

| | |
|---|---|
| Methane | 15–22% abs. |
| Nitrogen | 10–30% |
| Carbon dioxide | 20–25% |
| Water (steam) | up to 40% |
| Other gases | up to 7%. |

The test results were the same as those shown above for natural gas fuel.

Figure 22:
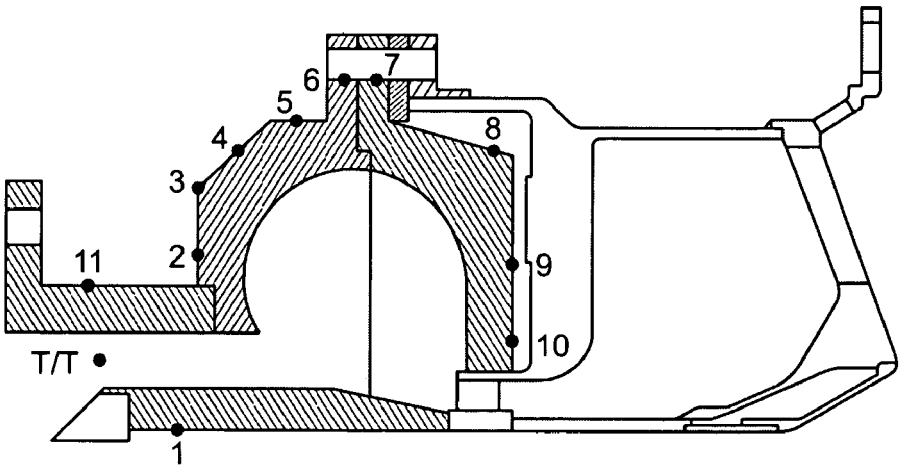
FIG. 22 shows temperature measurement points in a combustor liner.

Using a normal equivalent ratio for a concrete combustor (e.g. FIG. 22), the straight combustion reaction predominates over the reverse reaction. However, the reverse reactions of fuel reforming take place in blanket of the vortex and in this case the process is accompanied by temperature reduction of the vortex and as a result cause temperature reduction of the combustor walls (along of the gas stream). See Table 6.

It should be noted that a change in concentration of $CH_4$ and $O_2$ in the interfacing layers of the vortex flow and the fuel and air flow influences not only the thermal energy transfer process, but also the reaction direction (direct and reversed). If $CH_4$ concentration is more than normal for combustion in the fuel and air mixture (as a result of a coefficient of equivalence increase compared to the design setpoint value), fuel reforming processes will start prevailing in the interface layers. This, in combination with specifics of oxygen supply to the vortex, will result in the vortex peripheral temperature decrease, and as a consequence, the temperature of molecules that get to the central part of the vortex will also come down. Both processes, which occur simultaneously, would result in a decrease in the vortex temperature to a sub-critical value, resulting in a flameout. This is one reason why the problem of stable combustion of a lean mixture could not be resolved by simple mechanical mixing of the vortex flow and the fuel and air mixture flow as it has been done before because thermal energy supply to the fuel and air mixture in such case is accompanied by a concurrent increase in the $CO_2$ and $H_2O$ supply (resulting in intensified fuel reforming), with a decrease in temperature of the vortex and fuel and air mixture. However, because of the reactions that take place in the border "interface" layer of the present invention, a combustor in accordance with the present invention can be operated stably under such conditions. See Table 7. Such "reformation mode" operation may be stably and continuously conducted, even without the presence of a flame.

Tables 5 and 6: Combustion #2 (690 cm3) stability test results for a combustor metal liner (tests completed with gas fuel).

TABLE 5

| Test # | Initial fuel flow, sl/m ($\phi$ = 0.5) | Stable combustion fuel flow values, sl/m* | | | | | Flameout fuel flow sl/m | Flameout fuel flow t, ° C. |
|---|---|---|---|---|---|---|---|---|
| 1 | 60** | 50 | 45 | 40 | 35 | 30 | 26.9 | 325 |
| 2 | 52 | 45 | 41 | 36 | 30 | 27 | 23.1 | 323 |
| 3 | 45 | 40 | 32 | 28 | 25 | 23 | 19.1 | 325 |
| 4 | 40 | 33 | 29 | 25 | 21 | 19 | 16 | 330 |
| 5 | 35.5 | 30 | 26 | 22 | 20 | 18 | 15 | 331 |
| 6 | 30 | 29 | 23 | 19 | 18 | 16 | 13.2 | 330 |

*Standard liters per minute. The equivalence ratio was not determined. Only the fuel flow was changed, and the air flow remained unchanged
**60 sl/m is preferred consumption of fuel for the 690 cm3 combustor.

TABLE 6

| Point # | TIT (combustor exit temperature, ° C.) 1000 | 1150 | 1200 | 1250 | 1270 |
|---|---|---|---|---|---|
| 1 | 600 | 612 | 619 | 630 | 635 |
| 2 | 610 | 618 | 622 | 639 | 655 |
| 3 | 576 | 582 | 617 | 625 | 649 |
| 4 | 551 | 560 | 585 | 610 | 645 |
| 5 | 527 | 536 | 559 | 583 | 620 |
| 6 | 503 | 510 | 535 | 560 | 590 |
| 7 | 471 | 479 | 509 | 537 | 547 |
| 8 | 452 | 458 | 475 | 491 | 520 |
| 9 | 442 | 447 | 456 | 473 | 495 |

TABLE 6-continued

| Point # | TIT (combustor exit temperature, ° C.) 1000 | 1150 | 1200 | 1250 | 1270 |
|---|---|---|---|---|---|
| 10 | 436 | 441 | 448 | 469 | 487 |
| 11 | 620 | 625 | 631 | 648 | 663 |

Note. The metal temperatures were measured on the outside metal surface because the liner did not have any cooling.

TABLE 7

| Fuel flow, sl/m | CO2, % | CO, % | HC, ppm | O2, % | T3, ° C. | Shoot |
|---|---|---|---|---|---|---|
| 120 | 3.31 | 2.35 | 250 | 12.25 | 460 | 0 |

Preferred embodiments of the invention have been described above. It is, however, understood that various modifications and changes to the embodiments presented herein are possible without going beyond the spirit and scope of the invention defined in the attached claims.

The invention claimed is:

1. A combustor comprising:

a reactor;

an inlet for admitting a main flow of fluid to said reactor;

an exit for discharging heated fluid from said reactor;

said reactor positioned between said inlet and said exit and comprising a main flow zone, through which a majority of said main flow passes along a main flow path, and a recirculation zone, through which a lesser portion of said main flow passes;

wherein said recirculation zone is defined in part by a wall having an interior surface curved in one direction in a substantially continuous manner and running from a take off point proximate to said exit to a return point proximate to said inlet, said interior surface being shaped and positioned with respect to said main flow path in such a manner as to divert part of the fluid in said main flow path at said take off point to form a recirculation vortex flow in said recirculation zone during the operation of said reactor; and wherein said interior surface is further characterized by a lack of discontinuities so as to cause substantially undisturbed movement of a boundary layer along the periphery of said recirculation vortex flow.

2. The combustor of claim 1, wherein the volume of said recirculation zone is no less then the volume of said main flow zone, in the operating mode in which said reactor functions as a combustion chamber.

3. The combustor of claim 1, wherein the volume of said recirculation zone is no less than the double volume of said main flow zone, in the operating mode in which said reactor functions as a reformer.

4. The combustor of claim 1, wherein the volume of fluid entering said recirculation zone compared to the fluid discharged at said exit is no less than seven percent in the operating mode in which said reactor functions as a combustion chamber.

5. The combustor of claim 1, wherein the volume of fluid entering said recirculation zone compared to the fluid discharged at said exit is no less then ten percent in the operating mode in which said reactor functions as a reformer.

6. The combustor of claim 1, wherein the fluid within said boundary layer has a degree of turbulence of less than 0.2.

7. The combustor of claim 6, wherein said degree of turbulence is between 0.008 and 0.01.

8. The combustor of claim 1, wherein the direction of said recirculation flow at said take off point is at an angle of between 15 and 100 degrees to the direction of said main flow path at said take off point.

9. The combustor of claim 1, wherein the direction of said recirculation flow at said return point is at an angle of between 85 and 175 degrees to the direction of said main flow path at said return point.

10. The combustor of claim 1, wherein the ratio of the velocity of said recirculation vortex flow in the area proximate said inlet but outside of said boundary layer to the velocity of said main flow entering said main flow zone is in the range of no less than 1.4:1, in the operating mode in which said reactor functions as a combustion chamber.

11. The combustor of claim 1, wherein the ratio of the velocity of said recirculation vortex flow in the area proximate said inlet but outside of said boundary layer to the velocity of said main flow entering said main flow zone is in the range of no less then 2:1, in the operating mode in which said reactor functions as a reformer.

12. The combustor of claim 1, wherein said boundary layer has a depth of approximately 1 mm when said heated fluid at said exit has a temperature of approximately 1100° C.

13. The combustor of claim 1, wherein said boundary layer has a depth of approximately 2 mm when said heated fluid at said exit has a temperature of approximately 800° C.

14. The combustor of claim 1, wherein said boundary layer has a depth greater than the diameter of the central core of recirculating fluid in said recirculation vortex flow when said heated fluid at said exit has a temperature in the range of 380–420° C.

15. The combustor of claim 1, wherein the fluid within said recirculation vortex flow moves in layers and said layers are not substantially mixed radially within the vortex.

16. The combustor of claim 15, wherein heat energy is transferred from inner ones of said layers to outer ones of said layers.

17. The combustor of claim 1, wherein a high temperature relative to other temperatures within said reactor exists at the intersection of said peripheral vortex flow and said main flow passing through said inlet, and said peripheral vortex flow is moving in the same direction as said main flow after said main flow passes through said intersection, forming an interface layer between said peripheral vortex flow and said main flow, and wherein heat energy is transferred from the fluid in said peripheral vortex flow through said interface layer and into the fluid in said main flow zone.

18. The combustor of claim 17, wherein the fluid passing through said inlet, in the surface area of said fluid proximate to said interface layer, is fired by contact with said interface layer and acts as a pilot flame for the combustor.

19. The combustor of claim 17, wherein there is an absence of appreciable turbulent mixing between the fluid in said main flow and the fluid in said peripheral vortex flow.

20. The combustor of claim 17, wherein said interface layer causes a thermal nozzle to be established and maintained in said main flow zone.

21. The combustor of claim 17, wherein both combustion and fuel reformation take place within said interface layer where said interface layer meets with said main flow, and said combination of combustion and reformation is maintained during said operation of the combustor.

22. The combustor of claim 20, wherein the cross-sectional area of said exit is no more than 2.2 times the cross-sectional area of said inlet.

23. The combustor of claim 1, wherein, to change into the operating mode in which said reactor functions as a reformer, said inlet cross-sectional area is reduced relative to said inlet cross-sectional area employed in the operating mode in which said reactor operates as a combustion chamber.

24. A method of reacting fuel in a combustor, said combustor comprising a reactor; an inlet for admitting a main flow of fluid to said reactor; an exit for discharging heated fluid from said reactor; said reactor positioned between said inlet and said exit and comprising a main flow zone and a recirculation zone, said method comprising the steps of:

passing a majority of said main flow in a path along said main flow zone;

passing a lesser portion of said main flow in a path through said recirculation zone, so as to form a recirculating vortex flow that returns a portion of the fluid in said recirculation zone to an area proximate said inlet;

causing a boundary layer of recirculating fluid to flow along the interior wall surface of said recirculation zone without substantial turbulence;

causing the peripheral portion of said recirculating vortex flow to intersect said main flow in an area proximate said inlet, wherein, said peripheral flow has a higher velocity than said main flow; said peripheral flow, following the area of said intersection, is moving in approximately the same direction as said main flow;

mixing said peripheral flow and said main flow by diffusion, and not by substantial mechanical mixing;

thereby forming an interface layer between said main flow and said peripheral flow and causing a substantial transfer of heat energy from the fluid in said peripheral flow through said interface layer and into the fluid in said main flow zone.

25. The method of claim 24, wherein the volume of fluid entering said recirculation zone compared to the fluid discharged at said exit is no less than seven percent in the operating mode in which said reactor functions as a combustion chamber.

26. The method of claim 24, wherein the volume of fluid entering said recirculation zone compared to the fluid discharged at said exit is no less than ten percent in the operating mode in which said reactor functions as a reformer.

27. The method of claim 24, wherein said boundary layer of recirculating fluid flow along said interior wall surface of said recirculation zone has a degree of turbulence of less than 0.2.

28. The method of claim 27, wherein said boundary layer of recirculating fluid flow along said interior wall surface of said recirculation zone has a degree of turbulence of between 0.008 and 0.01.

29. The method of claim 24, wherein the ratio of said higher velocity of said peripheral vortex flow to the velocity of said main flow entering said main flow zone is in the range of no less than 1.4:1, in the operating mode in which said reactor functions as a combustion chamber.

30. The method of claim 24, wherein the ratio of said higher velocity of said peripheral vortex flow to the velocity of said main flow entering said main flow zone is in the range of no less than 2:1, in the operating mode in which said reactor functions as a reformer.

31. The method of claim 24 further comprising causing the fluid within said recirculation vortex flow to move in layers, wherein said layers are not substantially mixed radially within the vortex.

32. The method of claim 24, wherein heat energy is transferred from inner ones of said layers to outer ones of said layers.

33. The method of claim 24 further comprising causing the fluid entering through said inlet, in the surface area of said fluid proximate to said interface layer, to be fired by contact with said interface layer and thereby acting as a pilot flame for the combustor.

34. The method of claim 24 further comprising mixing the fluid in said main flow with the fluid in said peripheral vortex flow without causing appreciable turbulence.

35. The method of claim 24 further comprising causing a thermal nozzle to be established and maintained in said main flow zone.

36. The method of claim 24 further comprising causing both combustion and fuel reformation to take place within said interface layer, and maintaining said combination of combustion and reformation during the operation of the combustor.

37. The method of claim 24 further comprising changing the operating mode in which said reactor functions as a combustion chamber, to an operating mode in which said reactor functions as a reformer, by reducing the cross-sectional area of said inlet.

* * * * *